US011296421B2

(12) United States Patent
Han et al.

(10) Patent No.: US 11,296,421 B2
(45) Date of Patent: Apr. 5, 2022

(54) ANTENNA MODULE AND ELECTRONIC DEVICE INCLUDING ANTENNA MODULE

(71) Applicant: Samsung Electro-Mechanics Co., Ltd., Suwon-si (KR)

(72) Inventors: Myeong Woo Han, Suwon-si (KR); Ju Hyoung Park, Suwon-si (KR); Dae Ki Lim, Suwon-si (KR); Jeong Ki Ryoo, Suwon-si (KR); Won Cheol Lee, Suwon-si (KR); Nam Ki Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 51 days.

(21) Appl. No.: 16/654,481

(22) Filed: Oct. 16, 2019

(65) Prior Publication Data

US 2020/0395675 A1 Dec. 17, 2020

(30) Foreign Application Priority Data

Jun. 13, 2019 (KR) ..... 10-2019-0070176

(51) Int. Cl.
*H01Q 1/38* (2006.01)
*H01Q 21/00* (2006.01)
(Continued)

(52) U.S. Cl.
CPC ..... *H01Q 21/0025* (2013.01); *H01Q 1/2283* (2013.01); *H01Q 5/35* (2015.01); *H01Q 21/065* (2013.01); *H01Q 21/067* (2013.01)

(58) Field of Classification Search
CPC .... H01Q 21/0025; H01Q 5/35; H01Q 21/067; H01Q 21/065; H01Q 1/2283
See application file for complete search history.

(56) References Cited

U.S. PATENT DOCUMENTS 6,818,985 B1 * 11/2004 Coccioli ..... H01L 23/3128 257/240
8,467,737 B2 * 6/2013 Choudhury ..... H01L 23/552 455/73

(Continued)

FOREIGN PATENT DOCUMENTS

KR 10-2019-0038264 A 4/2019
WO WO 2019/066235 A1 4/2019

*Primary Examiner* — Dimary S Lopez Cruz
*Assistant Examiner* — Bamidele A Jegede
(74) *Attorney, Agent, or Firm* — NSIP Law

(57) ABSTRACT

An antenna module includes: an IC package including an IC; first and second antenna portions including respective patch antenna patterns, respective feed vias connected to the respective patch antenna patterns, and respective dielectric layers surrounding the respective feed vias; and a connection member having an upper surface on which the first and second antenna portions are disposed and a lower surface on which the IC package is disposed, the connection member forming an electrical connection path between the IC and the feed via of the first antenna portion and an electrical connection path of the second antenna portion. The connection member includes a first region disposed between the IC package and the first antenna portion, a second region on which the second antenna portion is disposed, and a third region electrically connecting the first and second regions and being more flexible than the dielectric layer of the first antenna portion.

16 Claims, 17 Drawing Sheets

(51) Int. Cl.

| | |
|---|---|
| ***H01Q 1/22*** | (2006.01) |
| ***H01Q 5/35*** | (2015.01) |
| ***H01Q 21/06*** | (2006.01) |

(56) References Cited

U.S. PATENT DOCUMENTS 8,754,815 B2 * 6/2014 Leem ..... H01Q 1/243 343/702
10,490,479 B1 * 11/2019 Wan ..... H01L 23/36
2006/0065433 A1 * 3/2006 Danoski ..... H01L 23/66 174/255
2008/0036668 A1 * 2/2008 White ..... H01Q 1/38 343/745
2009/0231225 A1 * 9/2009 Choudhury ..... H01Q 21/24 343/770
2009/0322643 A1 * 12/2009 Choudhury ..... H01Q 1/526 343/851
2011/0187602 A1 * 8/2011 Nair ..... C03C 3/19 343/700 MS
2012/0212384 A1 * 8/2012 Kam ..... G06K 19/07775 343/767
2012/0280380 A1 * 11/2012 Kamgaing ..... H01Q 1/2283 257/679
2013/0141284 A1 * 6/2013 Jeong ..... H01Q 1/2283 343/700 MS
2013/0189935 A1 * 7/2013 Nair ..... H01Q 1/2283 455/90.2
2014/0145316 A1 * 5/2014 Fujita ..... H01Q 9/0407 257/664
2014/0151860 A1 * 6/2014 Nakamura ..... H01L 23/66 257/664
2014/0152509 A1 * 6/2014 Liu ..... H01Q 9/0407 343/700 MS
2014/0203379 A1 * 7/2014 Teh ..... B81C 1/00087 257/415
2014/0266919 A1 * 9/2014 Chen ..... H01L 25/16 343/700 MS
2014/0285277 A1 * 9/2014 Herbsommer ..... H01P 5/107 333/1
2015/0346322 A1 * 12/2015 Schmalenberg ..... G01S 13/02 342/175
2016/0049723 A1 * 2/2016 Baks ..... H01Q 1/2291 343/848
2016/0172761 A1 * 6/2016 Garcia ..... G06K 19/077 343/700 MS
2016/0240492 A1 * 8/2016 Wolter ..... H01Q 1/2283
2017/0069958 A1 * 3/2017 Ko ..... H01Q 1/243
2017/0207517 A1 * 7/2017 Park ..... H01Q 1/48
2017/0222316 A1 * 8/2017 Mizunuma ..... H01Q 21/062
2017/0229769 A1 * 8/2017 Yokoyama ..... H01L 21/78
2018/0286822 A1 * 10/2018 Kim ..... H01L 23/5386
2018/0342788 A1 * 11/2018 Lasiter ..... H01L 23/66
2018/0358685 A1 * 12/2018 Han ..... H01L 23/49827
2019/0027808 A1 * 1/2019 Mow ..... H04R 1/025
2019/0036207 A1 * 1/2019 Kim ..... H01Q 9/285
2019/0103680 A1 * 4/2019 Liao ..... H01L 23/66
2019/0104212 A1 * 4/2019 Lee ..... H01Q 1/243
2019/0116670 A1 * 4/2019 Anderson ..... H05K 1/021
2019/0221917 A1 * 7/2019 Kim ..... H01L 23/5389
2019/0229402 A1 * 7/2019 Xia ..... H01Q 1/243
2019/0267722 A1 * 8/2019 Yoon ..... H01Q 1/523
2019/0306993 A1 * 10/2019 Kim ..... B32B 27/281
2019/0319337 A1 * 10/2019 Yen ..... H01L 23/5383
2019/0319338 A1 * 10/2019 Gu ..... H01L 21/4857
2019/0319341 A1 * 10/2019 Park ..... H01Q 1/243
2019/0326674 A1 * 10/2019 Kang ..... H01Q 9/26
2019/0348380 A1 * 11/2019 Chen ..... H01L 21/6835
2019/0355680 A1 * 11/2019 Chuang ..... H01Q 21/0087
2020/0021015 A1 * 1/2020 Yun ..... H01Q 25/00
2020/0036083 A1 * 1/2020 Kim ..... H01Q 21/065
2020/0091581 A1 * 3/2020 Ou ..... H05K 1/141
2020/0098709 A1 * 3/2020 Lin ..... H01L 23/49827
2020/0119453 A1 * 4/2020 Takayama ..... H04B 1/18
2020/0119454 A1 * 4/2020 Asrani ..... H01Q 1/243
2020/0153115 A1 * 5/2020 Yun ..... H01Q 9/065
2020/0161749 A1 * 5/2020 Onaka ..... H01Q 1/48
2020/0176376 A1 * 6/2020 Ndip ..... H01L 24/96
2020/0178401 A1 * 6/2020 Min ..... H01Q 1/38
2020/0373646 A1 * 11/2020 Murata ..... H01Q 1/2283

* cited by examiner

ANTENNA MODULE AND ELECTRONIC DEVICE INCLUDING ANTENNA MODULE

CROSS-REFERENCE TO RELATED APPLICATIONS

This application claims the benefit under 35 U.S.C. § 119(a) of Korean Patent Application No. 10-2019-0070176 filed on Jun. 13, 2019 in the Korean Intellectual Property Office, the entire disclosure of which is incorporated herein by reference for all purposes.

BACKGROUND

1. Field

The following description relates to an antenna module and an electronic device including an antenna module.

2. Description of Related Art

Mobile communications data traffic has rapidly increased on a yearly basis. A variety of techniques have been developed to support the rapidly increasing data in a wireless network in real time. For example, conversion of data based on Internet of Things (IoT) into contents, augmented reality (AR), virtual reality (VR), live VR/AR combined with SNS, autonomous driving, applications such as Sync View (transmitting a real-time image taken at a user time point using a micro-camera), and the like, may require communications (e.g., 5G communications, mmWave communications, or the like) supporting the transmission and reception of a large volume of data.

Accordingly, recently, studies of mmWave communications, including 5th generation communications, have been conducted, and studies on commercialization and standardization of an antenna module implementing such communications have also been conducted.

An RF signal of a high frequency band (e.g., 28 GHz, 36 GHz, 39 GHz, 60 GHz, and the like) may easily be absorbed and lost while being transmitted, which may cause degradation of communication quality. Thus, an antenna for communications in a high frequency band may require a technical approach different from a general antenna technique, and specific techniques such as implementing a power amplifier for securing an antenna gain, integration between an antenna and an RFIC, securing effective isotropic radiated power (EIRP), and the like, may be required.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, an antenna module includes: a first integrated circuit (IC) package including a first IC; a first antenna portion including a first patch antenna pattern, a first feed via electrically connected to the first patch antenna pattern, and a first antenna dielectric layer surrounding the first feed via, and configured to have a first resonance frequency; a second antenna portion including a second patch antenna pattern, a second feed via electrically connected to the second patch antenna pattern, and a second antenna dielectric layer surrounding the second feed via, and configured to have a second resonance frequency different from the first resonance frequency; and a connection member including an upper surface on which the first and second antenna portions are disposed and a lower surface on which the first IC package is disposed, and having a laminated structure forming an electrical connection path between the first IC and the first feed via and forming an electrical connection path of the second antenna portion. The connection member further includes a first region disposed between the first IC package and the first antenna portion, a second region on which the second antenna portion is disposed, and a third region electrically connecting the first and second regions and configured to be more flexible than the first antenna dielectric layer.

The second antenna portion may be configured to have a second bandwidth including 60 GHz. The first antenna portion may be configured to have a first bandwidth having a maximum frequency lower than a minimum frequency of the second bandwidth.

The antenna module may further include: a second IC package including a second IC, wherein the second region of the connection member is disposed between the second IC package and the second antenna portion, and forms an electrical connection path between the second IC and the second antenna portion.

The first IC package may further include a heat slug disposed on an inactive surface of the first IC. The second IC package may further include a heat sink disposed on an inactive surface of the second IC.

The first IC package may further include: a core member surrounding a portion of the first IC, electrically connected to the first and second ICs, and to configured to pass a base signal having a frequency lower than the first and second resonance frequencies; and a mounting electrical interconnect structure electrically connected to the core member and having a melting point lower than a melting point of the first feed via.

The connection member may form an electrical connection path between the first IC and the second IC. The first IC package may further include a heat slug disposed on an inactive surface of the first IC.

The first IC package may further include a second IC, and the connection member may form an electrical connection path between the second IC and the second antenna portion.

The connection member may further include a fourth region connected to the first region and configured to be more flexible than the first antenna dielectric layer. The fourth region may be configured to pass a base signal having a frequency lower than the first and second resonance frequencies.

The antenna module may further include: an end-fire antenna electrically connected to the second IC and configured to form a radiation pattern in a direction different from a direction of a radiation pattern of the second antenna portion. The second region may be disposed between the end-fire antenna and the second antenna portion.

Either one or both of the first and second antenna portions may further include an antenna interconnect structure disposed on the upper surface of the connection member to electrically connect the first feed via or the second feed via to the connection member, and having a melting point lower than a melting point of the first feed via or the second feed via.

Either one or both of the first and second antenna portions may further include a coupling patch pattern disposed on and spaced apart from the first patch antenna pattern or the second patch antenna pattern.

In another general aspect, an electronic device includes: a case; a set substrate disposed in the case; and an antenna module disposed in the case and electrically connected to the set substrate. The antenna module includes: a first IC package including a first IC; a first antenna portion including a first patch antenna pattern, a first feed via electrically connected to the first patch antenna pattern, and a first antenna dielectric layer surrounding the first feed via, and configured to have a first resonance frequency; a second antenna portion including a second patch antenna pattern, a second feed via electrically connected to the second patch antenna pattern, and a second antenna dielectric layer surrounding the second feed via, and configured to have a second resonance frequency different from the first resonance frequency; and a connection member including an upper surface on which the first and second antenna portions are disposed and a lower surface on which the first IC package is disposed, and having a laminated structure forming an electrical connection path between the first IC and the first feed via and forming an electrical connection path of the second antenna portion. The connection member further includes a first region disposed between the first IC package and the first antenna portion, a second region on which the second antenna portion is disposed, and a third region electrically connecting the first and second regions and configured to be more flexible than the first antenna dielectric layer.

The second antenna portion may be configured to have a second bandwidth including 60 GHz. The first antenna portion may be configured to have a first bandwidth having a maximum frequency lower than a minimum frequency of the second bandwidth.

The case may include a first surface, and a second surface having an area smaller than an area of the first surface. A distance between the second patch antenna pattern and the second surface may be less than a distance between the first patch antenna pattern and the second surface.

The first surface may be an upper surface or a lower surface of the case, and the second surface may be a side surface of the case.

The antenna module may further include a second IC package including a second IC. The second region may be disposed between the second IC package and the second antenna portion, and may form an electrical connection path between the second IC and the second antenna portion.

The antenna module may further include a fourth antenna portion, and the connection member may further include: a fourth region including surface on which the fourth antenna portion is disposed; and a fifth region electrically connecting the fourth region and the second region to each other, and configured to be more flexible than the first antenna dielectric layer.

The fourth antenna portion may include a fourth patch antenna.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
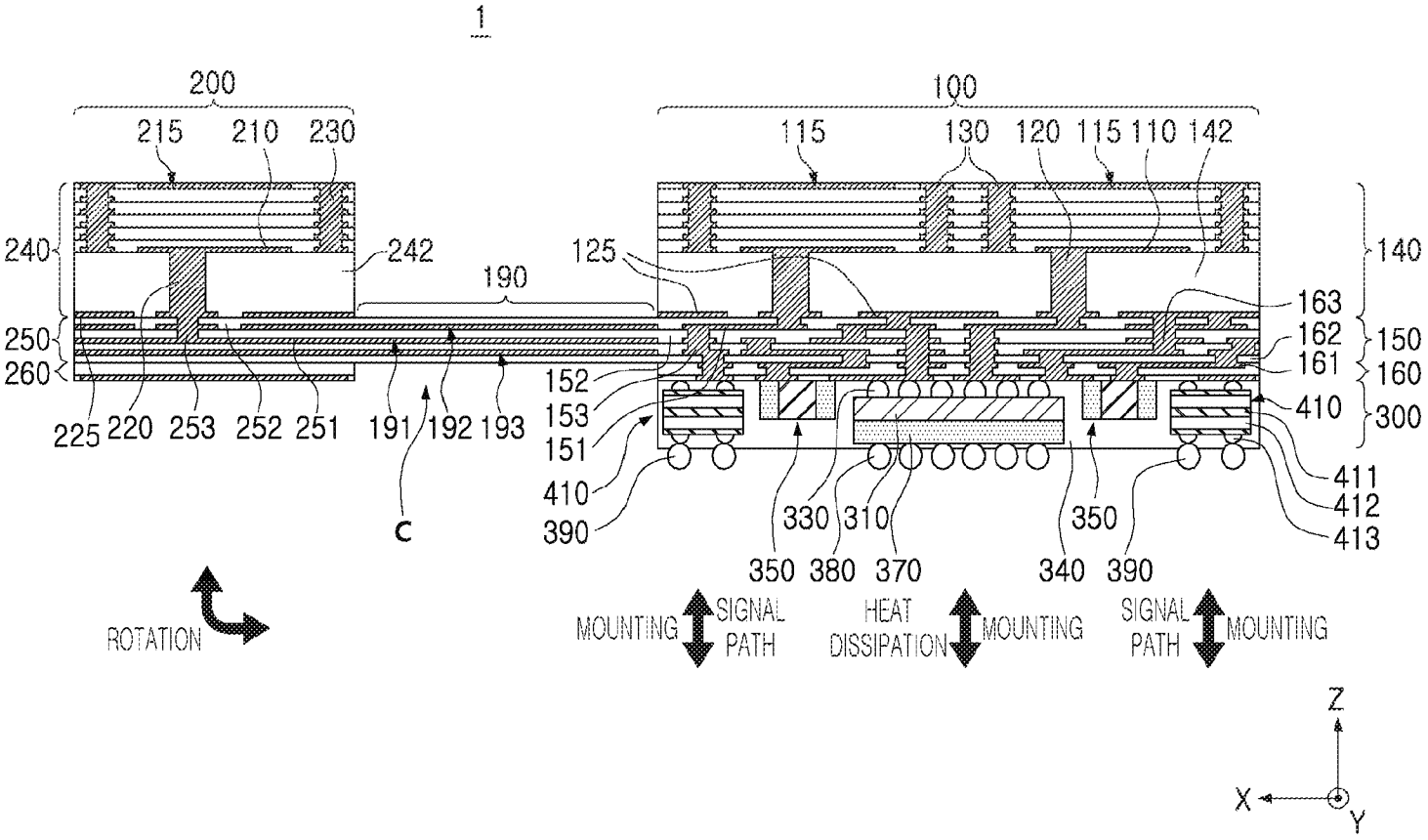
FIG. 1 is a side view illustrating an antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a side view illustrating an antenna module 1, according to an embodiment.

Referring to FIG. 1, the antenna module 1 may include a base module 100 and an expansion module 200, and may further include a connection member C electrically connecting the base module 100 and the expansion module 200. The connection member C may include first, second and third regions 150, 250, and 190.

The base module 100 may include a first antenna portion 140, the first region 150 of the connection member C, and an IC package 300, and may be mounted on a set substrate using a mounting electrical interconnect structure 390.

The base module 100 may receive a base signal from the set substrate and may generate a radio frequency (RF) signal, and may remotely transmit a portion of the generated RF signal. Similarly, the base module 100 may remotely receive a portion of an RF signal and may generate a base signal, and may transmit the generated base signal to the set substrate. The base signal may be an intermediate frequency (IF) signal or a baseband signal.

The base module 100 may transmit and receive an RF signal in a z direction. For example, the z direction may be defined as a direction opposite to a display direction of an electronic device (e.g., a portable terminal device).

Generally, when a user of an electronic device (e.g., a portable terminal device) holds the electronic device in a direction opposite to a display direction of the electronic device, a user's hand may block the electronic device in the z direction. In this case, the user's hand may interfere with remote transmission and reception of an RF signal such that communication quality of the electronic device may degrade, and power consumption of the electronic device may increase. The antenna module in the example embodiment may be configured to transmit and receive an RF signal in other directions as well as the z direction in an efficient manner.

The expansion module 200 may include a second antenna portion 240 and the second region 250 of the connection member C, and the expansion module 200 may not be mounted on the set substrate.

The expansion module 200 may remotely transmit the other portion of the RF signal generated in the base module 100. The expansion module 200 may also remotely receive the other portion of the RF signal and may transfer the other portion of the RF signal to the base module 100.

The expansion module 200 may transmit and receive an RF signal in a direction according to a dispositional form of the expansion module 200.

Referring to FIG. 1, the antenna module in the example embodiment may further include the third region 190 of the connection member C electrically connecting the first region 150 of the connection member C in the base module 100 and the second region 250 of the connection member C in the expansion module 200 to each other.

The first, second and third regions 150, 250, and 190 of the connection member C may form a laminated structure. Accordingly, the connection member C may have a relatively short length in the z direction, and an electrical length from a first IC 310 to first and second patch antenna patterns 110 and 210 may be reduced, and transmission loss of an RF signal may be reduced.

The third region 190 of the connection member C may be configured to be more flexible than the base module 100 and the expansion module 200. For example, the base module 100, the third region 190 of the connection member C, and the expansion module 200 may be implemented on a rigid-flexible printed circuit board (RFPCB), but the disclosure is not limited to this example.

For example, a first antenna dielectric layer 142 and a first signal path dielectric layer 152 included in the base module 100, and a second antenna dielectric layer 242 and a second signal path dielectric layer 252 included in the expansion module 200 may be implemented by prepreg, FR4, low temperature co-fired ceramic (LTCC), or glass, and a dielectric layer included in the third region 190 of the connection member C may be implemented by liquid crystal polymer (LCP) or polyimide, which are more flexible than the above-mentioned materials. However, the description is not limited to the foregoing example materials, and the materials may be varied depending on a design specification (e.g., flexibility, a dielectric constant, ease of coupling between a plurality of substrates, durability, costs, and the like).

A reference of flexibility of a dielectric layer and/or an insulating layer may be defined based on power applied when an object to be measured having a unit size is damaged (e.g., breakage, cracks, and the like) after applying power to a central region of one surface of the object and gradually increasing the power until the object is damaged.

The base module 100 may be configured to be fixed onto the set substrate, and accordingly, the expansion module 200 may rotate as the third region 190 of the connection member C is bent.

For example, the expansion module 200 may rotate by 90 degrees with respect to the base module 100 and may transmit and receive an RF signal in an x direction and/or a y direction.

In example embodiments, the expansion module 200 may rotate by 180 degrees with respect to the base module 100 and may transmit and receive an RF signal in a −z direction.

Thus, the direction in which an RF signal is transmitted from and received in the expansion module 200 may be easily configured and may be varied.

Thus, the antenna module 1 may transmit and receive an RF signal in the z direction using the base module 100, and may also effectively transmit and receive an RF signal in other directions as well as the z direction using the expansion module 200.

A spacing distance between the base module 100 and the expansion module 200 may be varied depending on the bending of the third region 190 of the connection member C.

Thus, in the antenna module 1, the expansion module 200 may be configured to be disposed in a position in which an RF signal may be effectively transmitted and received in the electronic device (e.g., a portable terminal device), and the antenna module 1 may thus effectively transmit and receive an RF signal.

The first antenna portion 140 may include at least portions of a first patch antenna pattern 110, a first coupling patch pattern 115, a first feed via 120, a first ground layer 125, a first coupling structure 130, and the first antenna dielectric layer 142.

The second antenna portion 240 may include at least portions of a second patch antenna pattern 210, a second coupling patch pattern 215, a second feed via 220, a second coupling structure 230, and the second antenna dielectric layer 242.

The first and second patch antenna patterns 110 and 210 may be electrically connected to first ends of the first and second feed vias 120 and 220, respectively. The number of each of the first and second patch antenna patterns 110 and 210 may be two or more. The higher the number of each of the first and second patch antenna patterns 110 and 210, the more the gain of the first and second patch antenna patterns 110 and 210 may improve.

The first and second patch antenna patterns 110 and 210 may transmit and receive an RF signal through a plane (e.g., an upper surface and a lower surface). As an RF signal transmitted and received through a lower plane may be reflected from the first ground layer 125 and a second ground layer 225 of the expansion module 200, the first and second patch antenna patterns 110 and 210 may focus a radiation pattern in a direction in which an upper plane is oriented.

As each of the first and second patch antenna patterns 110 and 210 may more easily focus a reflective pattern in one direction using a relatively wide plane as compared to other types of antennas (e.g., a dipole antenna, a monopole antenna), the first and second patch antenna patterns 110 and 210 may have improved gains and bandwidths as compared to other types of antennas.

The first and second coupling patch patterns 115 and 215 may overlap the first and second patch antenna patterns 110 and 210, respectively, in the z direction (or a layering direction), respectively, and may be electromagnetically coupled to the first and second patch antenna patterns 110 and 210, respectively. The combined structure of the patch antenna pattern 110/210 and the coupling patch pattern 115/215 may improve a gain by expanding the plane for transmitting and receiving an RF signal, and may expand a bandwidth using capacitance formed by the patch antenna pattern 110/210 and the coupling patch pattern 115/215.

The first and second feed vias 120 and 220 may be connected to the first and second regions 150 and 250 of the connection member C, respectively. When the number of each of the first and second patch antenna patterns 110 and 210 is two or more, the number of each of the first and second feed vias 120 and 220 may also be two or more.

A length of each of the first and second feed vias 120 and 220 may be determined based on an optimal spacing distance (e.g., ½ times or ¼ times a wavelength of an RF signal) between the first and second patch antenna patterns 110 and 210 and the first and second ground layers 125 and 225, respectively.

The first ground layer 125 may be disposed in a lower region of the first patch antenna pattern 110. The first ground layer 125 may work as a reflector for the first patch antenna pattern 110 and may more focus an RF signal to an upper region.

The first and second coupling structures 130 and 230 may surround at least portions of the first and second patch antenna patterns 110 and 210, respectively, in a horizontal direction (e.g., x direction and/or y direction).

The first and second coupling structures 130 and 230 may reflect an RF signal leaking from side surfaces (e.g., viewed in x direction and/or y direction) of the first and second patch antenna patterns 110 and 210, respectively, or may alter a penetration direction of the leaking RF signal to focus the leaking RF signal more to an upper region.

When the number of each of the first and second patch antenna patterns 110 and 210 is two or more, the first and second coupling structures 130 and 230 may reduce electromagnetic interference between the patch antenna patterns. Accordingly, a beamforming efficiency of the first and second patch antenna patterns 110 and 210 may improve, and gains of the first and second patch antenna patterns 110 and 210 may improve.

The first and second antenna dielectric layers 142 and 242 may surround at least portions of the first and second feed vias 120 and 220, respectively.

The first and second antenna dielectric layers 142 and 242 may have a dielectric constant Dk greater than a dielectric constant of air, and may have an insulation property. A dielectric constant of the first and second antenna dielectric layers 142 and 242 may be configured to be relatively high to reduce sizes of the first and second antenna portions 140 and 240, and may also be configured to be relatively small for bandwidths or an efficiency in signal transmission and reception of the first and second antenna portions 140 and 240.

The first antenna portion 140 may be configured to have a first resonance frequency (e.g., 28 GHz, 39 GHz, or the like), and the second antenna portion 240 may be configured to have a second resonance frequency (e.g., 60 GHz) different from the first resonance frequency. Thus, the antenna module 1 may remotely transmit and receive an RF signal of a first frequency through the first antenna portion 140, and may remotely transmit and receive an RF signal of a second frequency through the second antenna portion 240.

For example, as the first patch antenna pattern 110 of the first antenna portion 140 may be configured to have a size greater than a size of the second patch antenna pattern 210 of the second antenna portion 240, the first patch antenna pattern 110 may have the first resonance frequency lower than the second resonance frequency.

For example, the second antenna portion 240 may be configured to have a second bandwidth including 60 GHz, and the first antenna portion 140 may be configured to have a first bandwidth having a maximum frequency lower than a minimum frequency of the second bandwidth.

The second bandwidth including 60 GHz may be more relatively appropriate for remotely transmitting a large volume data to and receiving a large volume of data from a communication object disposed relatively close to the antenna module 1. The first band (e.g., 28 GHz, 39 GHz) of a frequency lower than 60 GHz may be relatively appropriate for remotely transmitting data to and receiving data from a communication object disposed relatively remote from the antenna module 1.

Thus, when the second antenna portion 240 forms a radiation pattern in a horizontal direction and the first antenna portion 140 forms a radiation pattern in a vertical direction in the electronic device, the electronic device may effectively perform both large-scale near-field communications of the second bandwidth corresponding to 60 GHz and long distance communications in the first bandwidth.

In the embodiment of FIG. 1, as the antenna module 1 includes the structure of the first, second and third regions 150, 250, and 190 of the connection member C, a normal direction of the first patch antenna pattern 110 (e.g., a direction normal to the plane in which the first patch antenna 110 extends) of the first antenna portion 140 may be configured to be vertical (e.g., z direction), and a normal direction of the second patch antenna pattern 210 may be configured to be horizontal (e.g., an x direction and/or a y direction). Accordingly, the first antenna portion 140 may form a radiation pattern in a vertical direction (e.g., z direction), and the second antenna portion 240 may form a radiation pattern in a horizontal direction (e.g., x direction and/or y direction).

The first and second regions 150 and 250 of the connection member C may be disposed in lower regions of the first and second antenna portions 140 and 240, respectively, and may be connected to each other through the third region 190 of the connection member C.

The first and second regions 150 and 250 of the connection member C may include at least portions of first and second signal path wiring layers 151 and 251, first and second signal path dielectric layers 152 and 252, and first and second signal path wiring vias 153 and 253.

The first and second signal path wiring layers 151 and 251 may be connected to the first and second feed vias 120 and 220, respectively.

The first and second signal path dielectric layers 152 and 252 may have an insulation property, and may have flexibility higher than flexibility of the first and second antenna dielectric layers 142 and 242. Accordingly, the first and second regions 150 and 250 of the connection member C may be integrated with the third region 190 of the connection member C.

The first and second signal path wiring vias 153 and 253 may be electrically connected to the first and second signal path wiring layers 151 and 251, respectively.

The first signal path wiring via 153 may be connected to a circuit support member 160.

The circuit support member 160 may be disposed between the first region 150 of the connection member C and the IC package 300, and may include portions of a circuit wiring layer 161, a circuit dielectric layer 162, and a circuit wiring via 163.

The circuit wiring layer 161 may electrically connect the first signal path wiring layer 151 and the first IC 310. The circuit wiring layer 161 may also electrically connect the first IC 310 and a passive component 350. The circuit wiring layer 161 may provide an electrical ground to the first IC 310.

The circuit dielectric layer 162 may have a dielectric constant Dk greater than a dielectric constant of air, and may have an insulation property. In example embodiments, the circuit dielectric layer 162 may have a relatively low dielectric tangent Df to reduce loss of an RF signal.

The circuit wiring via 163 may be connected between the circuit wiring layer 161 and the first signal path wiring layer 151, or may be connected between the circuit wiring layer 161 and the first IC 310 and/or the passive component 350.

The third region 190 of the connection member C may include an RF signal expansion path wire 191 and RF signal expansion path ground layers 192 and 193.

The RF signal expansion path wire 191 may be electrically connected between the first and second signal path wiring layers 151 and 251. Accordingly, the RF signal expansion path wire 191 may provide an RF signal expansion path between the base module 100 and the expansion module 200.

The RF signal expansion path ground layers 192 and 193 may be disposed in an upper region and/or a lower region of the RF signal expansion path wire 191. Accordingly, the RF signal expansion path wire 191 may be protected from external electromagnetic noise.

A support member 260 may be fixed in the electronic device (e.g., a portable terminal device) of the expansion module 200. For example, the support member 260 may include an adhesive member and may be adhered to the electronic device, or the support member 260 may include a physical coupling member and may be physically coupled to the electronic device.

The IC package 300 may provide a mounting structure for the base module 100 on the set substrate, may provide an input and output path for a base signal with respect to the set substrate, may provide a disposition space in which the first IC 310 is disposed, and may have a structure which may effectively dissipate heat produced from the first IC 310.

The first IC 310 may receive a base signal and may generate an RF signal, or may receive an RF signal and may generate a base signal. For example, the first IC 310 may generate a converted signal by performing at least portions of operations of frequency conversion, amplification, filtering, phase-control, and power generation in relation to a received signal.

For example, the first IC 310 may have an active surface (e.g., an upper surface) electrically connected to the first region 150 of the connection member C, and an inactive surface (e.g., a lower surface) providing a disposition space in which a heat slug 370 is disposed.

An IC electrical interconnect structure 330 may provide an electrical coupling structure between the first IC 310 and the circuit support member 160. For example, the IC electrical interconnect structure 330 may have a structure such as a solder ball, a pin, a land, a pad, and the like.

An encapsulant 340 may encapsulate at least a portion of each of the first IC 310 and the passive component 350, and the encapsulant 340 may thus protect the first IC 310 and the passive component 350 from external factors. For example, the encapsulant 340 may be implemented by a photo imageable encapsulant (PIE), an Ajinomoto build-up film (ABF), an epoxy molding compound (EMC), or the like.

The passive component 350 may provide capacitance, inductance, or resistance to the first IC 310. For example, the passive component 350 may include at least portions of a capacitor (multilayer ceramic capacitor, MLCC), an inductor, or a chip resistor. In example embodiments, the passive component 350 may perform portions of operations (e.g., filtering, amplification) of the first IC 310 in relation to the first IC 310.

The mounting electrical interconnect structure 390 may provide an electrical coupling structure between the IC package 300 and the set substrate, and may support the mounting of the base module 100 on the set substrate. The mounting electrical interconnect structure 390 may provide an input and output path for a base signal with respect to the set substrate, and may have a structure similar to the structure of the IC electrical interconnect structure 330.

A core member 410 may provide one surface disposed in the first region 150 of the connection member C and another surface on which the mounting electrical interconnect structure 390 is disposed, and may be spaced apart from the first IC 310.

Accordingly, the core member 410 may be disposed between the first region 150 of the connection member C and the set substrate, and the mounting electrical interconnect structure 390 may be disposed between the core member 410 and the set substrate.

For example, the core member 410 may surround at least a portion of the first IC 310, may be electrically connected to the mounting electrical interconnect structure 390, may provide a transmission path for a base signal, and may support the base module 100.

In example embodiments, the core member 410 may be implemented as a fan-out panel level package (FOPLP), and may improve efficiency (e.g., a loss rate, ground stability, and the like) of a transmission path for a base signal or may provide an electromagnetic shielding performance.

The core member 410 may include at least portions of a core wiring 411, a core dielectric layer 412, and a core via 413 corresponding to the circuit wiring layer 161, the circuit dielectric layer 162, and the circuit wiring via 163, respectively.

The heat slug 370 may absorb heat produced from the first IC 310, and may transmit the absorbed heat to a heat dissipation structure 380. For example, the heat slug 370 may be implemented by a metal slag such that an efficiency of heat absorption and dissipation may improve.

The heat slug 370 may be disposed between the first IC 310 and the set substrate, and may be electrically connected to the set substrate through the heat dissipation structure 380.

The heat dissipation structure 380 may be electrically connected to the heat slug 370 and may dissipate heat received from the heat slug 370 to the set substrate. For example, the heat dissipation structure 380 may have a structure corresponding to the structure of the mounting electrical interconnect structure 390, and a plurality of the heat dissipation structures 380 may form a heat sink structure such that a heat dissipation efficiency may be improved.

The heat slug 370 and the heat dissipation structure 380 may dissipate heat produced from the first IC 310 in accordance with an RF signal transmitted from and received in the base module 100, and may also dissipate heat produced from the first IC 310 in accordance with an RF signal transmitted from and received in the expansion module 200.

Accordingly, it may not be necessary for the expansion module 200 to include a heat dissipation structure, and the expansion module 200 may therefore be configured more flexibly in an electronic device. Further, the support member 260 may be used more effectively such that disposition stability may improve.

Figure 2A:
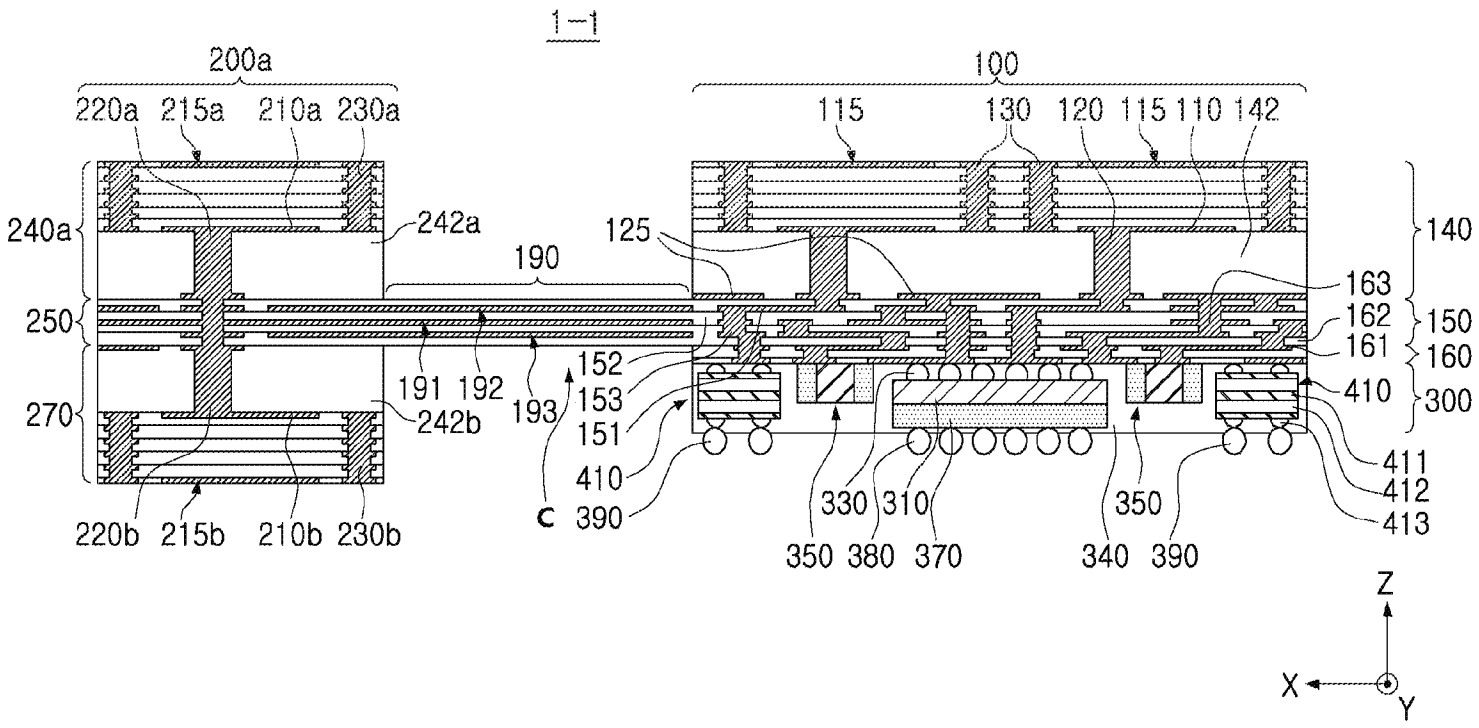
FIG. 2A is a side view illustrating an antenna module including a third antenna portion, according to an embodiment.

FIG. 2A is a side view illustrating an antenna module 1-1 including a third antenna portion 270, according to an embodiment.

Referring to FIG. 2A, the antenna module 1-1 may further include, in comparison to the antenna module 1 of FIG. 1, the third antenna portion 270 disposed on a surface (e.g., a lower surface) of a second region 250 of the connection member C that is different from a surface (e.g., an upper surface) on which a second antenna portion 240*a* of an expansion module 200*a* is disposed.

Accordingly, a direction and/or a position in which an RF signal is remotely transmitted and received may be determined more flexibly in an electronic device.

For example, the third antenna portion 270 may include a third patch antenna pattern 210*b* corresponding to a second patch antenna pattern 210*a* of the second antenna portion 240*a*, a third coupling patch pattern 215*b* corresponding to a second coupling patch pattern 215*a* of the second antenna portion 240*a*, a third feed via 220*b* corresponding to a second feed via 220*a* of the second antenna portion 240*a*, a third coupling structure 230*b* corresponding to a second coupling structure 230*a* of the second antenna portion 240*a*, and a third antenna dielectric layer 242*b* corresponding to a second antenna dielectric layer 242*a* of the second antenna portion 240*a*.

Figure 2B:
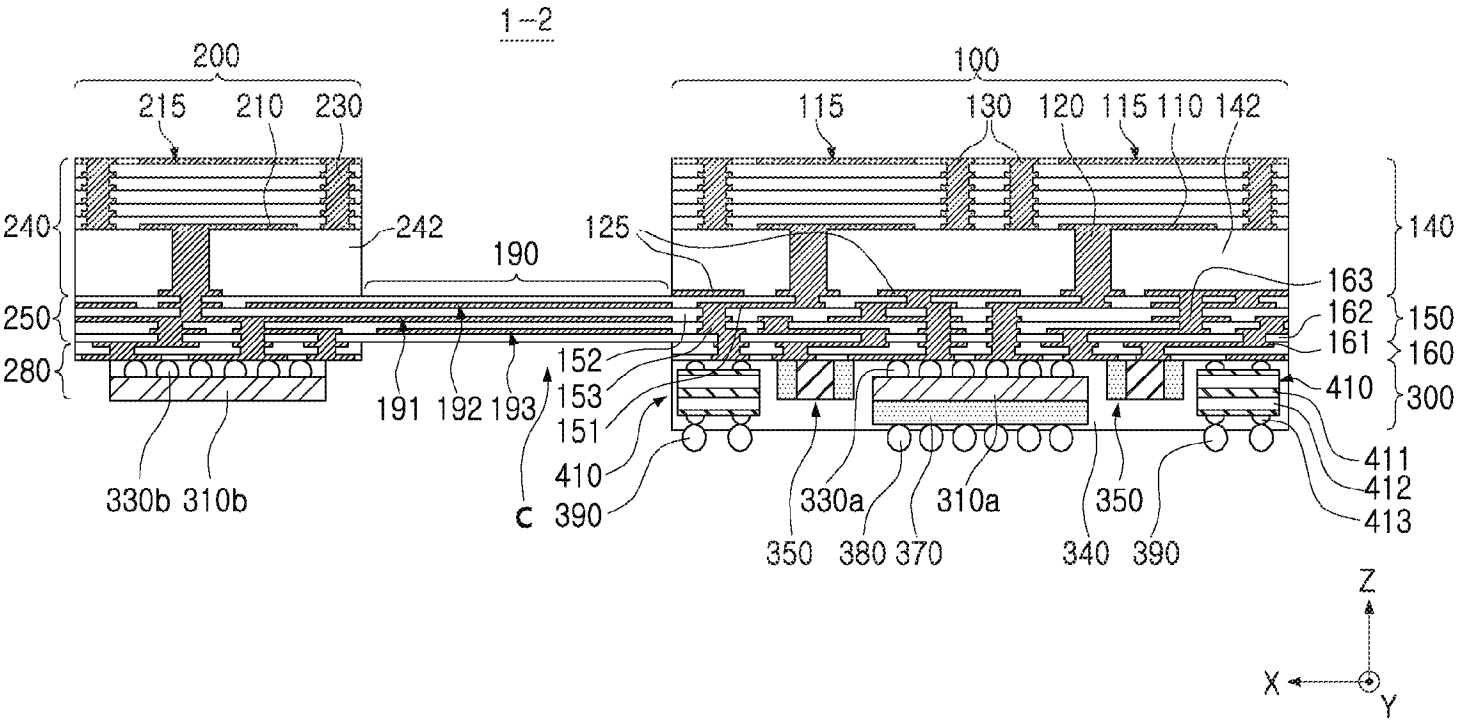
FIG. 2B is a side view illustrating an antenna module including a second IC package, according to an embodiment.

FIG. 2B is a side view illustrating an antenna module 1-2 including a second IC package 280, according to an embodiment.

Referring to FIG. 2B, the antenna module 1-2 may include a second IC 310*b*, and may further include the second IC package 280 disposed on a surface (e.g., a lower surface) of the second region 250 of the connection member C that is different from a surface (e.g., an upper surface) on which the second antenna portion 240 is disposed.

The second IC 310*b* may perform operations similar to operations of the first IC 310*a*, may be configured to have an operational frequency higher than an operational frequency of the first IC 310*a*, and may be disposed in the second region 250 of the connection member C through a second IC electrical interconnect structure 330*b* corresponding to the IC electrical interconnect structure 330*a*.

The second region 250 of the connection member may be disposed between the second IC package 280 and the second antenna portion 240, and may provide an electrical connection path between the second IC package 280 and the second antenna portion 240.

Since a frequency of a second RF signal transmitted from and received in the second antenna portion 240 is higher than a frequency of a first RF signal transmitted from and received in the first antenna portion 140, transmission loss of the second RF signal in the connection member C may be greater than transmission loss of the first RF signal in the connection member C.

As an electrical length from a second patch antenna pattern 210 to the second IC 310*b* is shorter than an electrical length from the second patch antenna pattern 210 to the first IC 310*a*, transmission loss of the second RF signal transmitted from and/or received in the second patch antenna pattern 210 may be reduced.

Thus, in the antenna module 1-2, overall transmission loss in a transmission line in relation to first and second bands may be reduced.

Heat produced from the second IC 310*b* may be transmitted to a mounting electrical interconnect structure 390 through the RF signal expansion path ground layers 192 and 193 of a third region 190 of the connection member C. Accordingly, the antenna module 1-2 may secure a heat dissipation performance of the expansion module 200, which is not mounted on a set substrate.

Figure 2C:
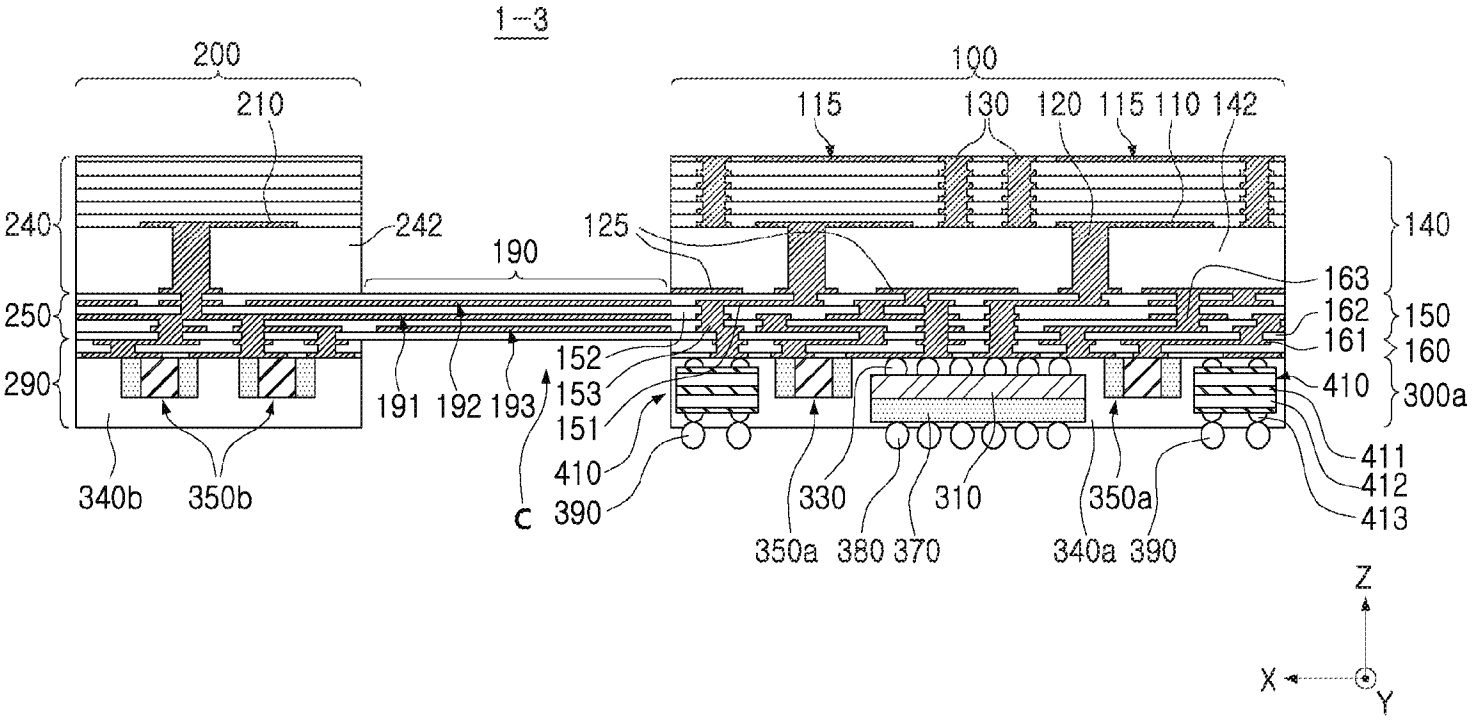
FIG. 2C is a side view illustrating an antenna module including a passive component package, according to an embodiment.

FIG. 2C is a side view illustrating an antenna module 1-3 including a passive component package 290, according to an embodiment.

Referring to FIG. 2C, the antenna module 1-3 may include a passive component package 290 including a second passive component 350*b* disposed on a surface (e.g., a lower surface) of the second region 250 of the connection member C that is different from a surface (e.g., an upper surface) on which the second antenna portion 240 is disposed, and a second encapsulant 340*b* encapsulating at least a portion of the second passive component 350*b*.

The second passive component 350*b* may correspond to a first passive component 350*a* of an IC package 300*a*, and the second encapsulant 340*b* may correspond to a first encapsulant 340*a* of the IC package 300*a*.

Accordingly, in the antenna module 1-3, a disposition space in which the passive components 350*a* and 350*b* are disposed may be divided into the IC package 300*a* and the passive component package 290. Thus, the antenna module 1-3 may have a reduced size by reducing a size of the IC package 300*a*.

Figure 2D:
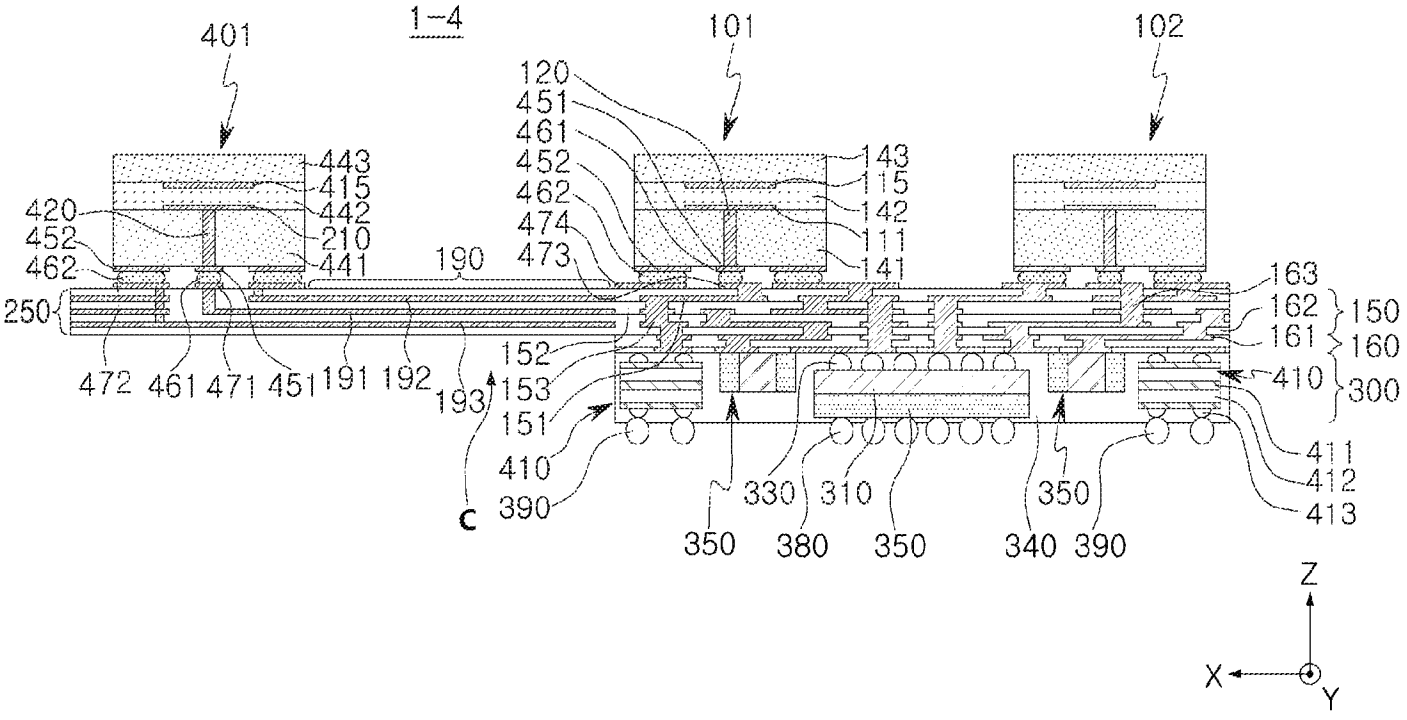
FIG. 2D is a side view illustrating a mounting structure of first and second antenna portions included in an antenna module, according to an embodiment.

FIG. 2D is a side view illustrating a mounting structure of first and second antenna portions included in an antenna module 1-4, according to an embodiment.

Referring to FIG. 2D, either one or both of first antenna portions 101 and 102 and a second antenna portion 401 may include an antenna interconnect structure 461 disposed on an upper surface of a first region 150 or a second region 250 of the connection member C to electrically connect the first feed via 120 or a second feed via 420 to the first region 150 or the second region 250 of the connection member C and having a melting point lower than a melting point of the first feed via 120 or the second feed via 420.

The first and second patch antenna patterns 110 and 210 may remotely transmit and/or receive an RF signal in a normal direction of an upper surface (e.g., a direction normal to the upper surface). For example, the first and second patch antenna patterns 110 and 210 may be disposed on upper surfaces of first and second antenna dielectric layers 141 and 441.

The first and second feed vias 120 and 420 may electrically connect the first and second patch antenna patterns 110 and 210 to the first and second regions 150 and 250 of the connection member C, and may work as electrical paths of an RF signal.

For example, the first and second feed vias 120 and 420 may be formed by filling through-holes of the first and second antenna dielectric layers 141 and 441, respectively.

The antenna interconnect structure 461 may electrically connect the first and second feed vias 120 and 420 to the first and second regions 150 and 250, respectively, of the connection member C, and may have a melting point lower than a melting point of the first and second feed vias 120 and 420.

Accordingly, the first antenna portions 101, 102 and the second antenna portion 401 may be separately manufactured for the first and second regions 150 and 250 of the connection member C, and may be disposed in the first and second regions 150 and 250, respectively, of the connection member C. For example, the first and second antenna portions 101, 102, and 401 may be separately manufactured and may be respectively disposed on upper surfaces of the first and second regions 150 and 250 of the connection member C, such that an antenna feed pattern 451 and connection member feed patterns 471 and 473 may overlap with each other. Accordingly, the antenna interconnect structure 461 may be disposed to be in contact with the antenna feed pattern 451 and the connection member feed patterns 471 and 473 at a temperature higher than a melting point of the antenna interconnect structure 461 and lower than a melting point of the first and second feed vias 120 and 420, such that the first antenna portions 101, 102, and antenna portion 401 may be respectively mounted on the first and second regions 150 and 250 of the connection member C.

For example, the first and second antenna portions 101, 102 and the second antenna portion 401 may further include an antenna ground pattern 452 disposed on lower surfaces of the first and second antenna dielectric layers 141 and 441, and may be electrically connected to connection member ground patterns 472 and 474. An antenna ground pattern 452 may be electrically connected to the connection member ground patterns 472 and 474 through a ground interconnect structure 462. The ground interconnect structure 462 may have substantially the same properties as properties of the antenna interconnect structure 461.

Accordingly, the first antenna portions 101, 102 and the second antenna portion 401 may be stably fixed onto the first and second regions 150 and 250 of the connection member C.

The first and second antenna dielectric layers 141 and 441 may have a dielectric constant higher than a dielectric constant of air, and may affect shapes and sizes of the first and antenna portions 101, 102 and the second antenna portion 401.

For example, the first and second antenna dielectric layers 141 and 441 may be formed of ceramic, and may thus have a dielectric constant higher than a dielectric constant of insulating layers of the first and second regions 150 and 250 of the connection member. Since the first antenna portions 101, 102 and the second antenna portion 401 are separately manufactured for the first and second regions 150 and 250 of the connection member and may be respectively disposed in the first and second regions 150 and 250 of the connection member C, the first and second antenna dielectric layers 141 and 441 may be configured without consideration of structural compatibility with the connection member C. Thus, the first and second antenna dielectric layers 141 and 441 may easily be implemented by a material having a relatively high dielectric constant such as a ceramic.

The higher the dielectric constant of the first and second antenna dielectric layers 141 and 441, the shorter the effective wavelength of an RF signal in the first and second antenna dielectric layers 141 and 441, and the shorter the effective wavelength of an RF signal in the first and second antenna dielectric layers 141 and 441, the more the overall sizes of the first antenna portions 101, 102 and the second antenna portion 401 may be reduced.

The higher the number of first and second patch antenna patterns 110 and 210, the higher the gains of the first portions 101, 102 and the second antenna portion 401 may be. Overall sizes of the first antenna portions 101, 102 and the second antenna portion 401 may be proportional to the number of the first and second patch antenna patterns 110 and 210, respectively.

Thus, the higher the dielectric constants of the first and second antenna dielectric layers 141 and 441, the higher the ratio of gains to sizes of the first antenna portions 101, 102 and the second antenna portion 401 may be.

As the first and second antenna dielectric layers 141 and 441 may easily be implemented by a material having a relatively high dielectric constant, in the antenna module in the example embodiment, the gains to size ratios of the first antenna portions 101, 102 and the second antenna portion 401 may easily improve.

Figure 2E:
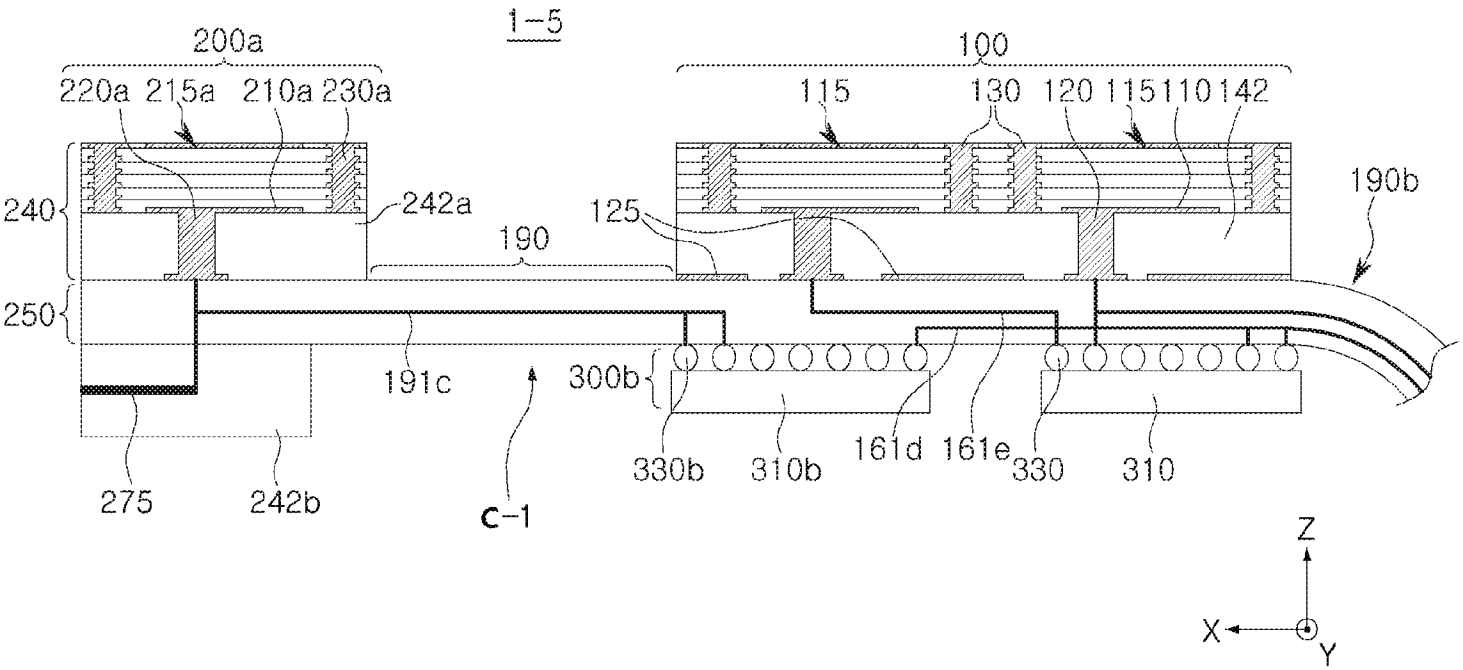
FIG. 2E is a side view illustrating a second IC, an end-fire antenna, and a fourth region of a connection member included in an antenna module, according to an embodiment.

FIG. 2E is a side view illustrating a second IC 310*b*, an end-fire antenna 275, and a fourth region 190*b* of a connection member C-1 included in an antenna module 1-5, according to an embodiment.

Referring to FIG. 2E, the connection member C-1 of the antenna module 1-5 may further include the fourth region 190*b* of the connection member C-1 connected to the first region 150 of the connection member C-1 and configured to be more flexible than the first region 150 of the connection member C-1.

The fourth region 190*b* of the connection member C-1 may be configured to pass a base signal having a frequency lower than first and second resonance frequencies, and may thus provide an input and output path for a base signal with respect to a set substrate. The base signal may flow to a fourth circuit wiring layer 161*d*, and the fourth region 190*b* of the connection member may provide a portion of a disposition space in which the fourth circuit wiring layer 161*d* is disposed.

Referring to FIG. 2E, both of the first IC 310 and a second IC 310*b* may be disposed in the first region 150 of the connection member C-1. A first IC package 300*b* may thus include both of the first IC 310 and the second IC 310*b*.

The first IC 310 may be electrically connected to the first feed via 120 through a fifth circuit wiring layer 161*e*, and the second IC 310*b* may be electrically connected to the second feed via 220*a* through an RF signal expansion path wire 191*c*.

Accordingly, the third region 190 of the connection member may provide an electrical connection path between the second IC 310*b* and the second antenna portion 240.

Referring to FIG. 2E, the antenna module 1-5 may further include the end-fire antenna 275 electrically connected to the first IC 310 or the second IC 310*b*. The end-fire antenna 275 may be configured to form a radiation pattern in a direction (e.g., an x direction) different from a direction of a radiation pattern of the second antenna portion 240. The second region 250 of the connection member may be disposed between the end-fire antenna 275 and the second antenna portion 240.

The end-fire antenna 275 may be disposed inside a third antenna dielectric layer 242*b*. Alternatively, in example embodiments, the end-fire antenna 275 may also be disposed in the second region 250 of the connection member.

When the third region 190 of the connection member is bent by 90 degrees, the end-fire antenna 275 may form a radiation pattern in a direction different from directions in which radiation patterns of first and second patch antenna patterns 110 and 210*a* are formed by 180 degrees or 90 degrees.

Accordingly, the antenna module 1-5 may easily expand the direction in which an RF signal is remotely transmitted and received.

Figure 2F:
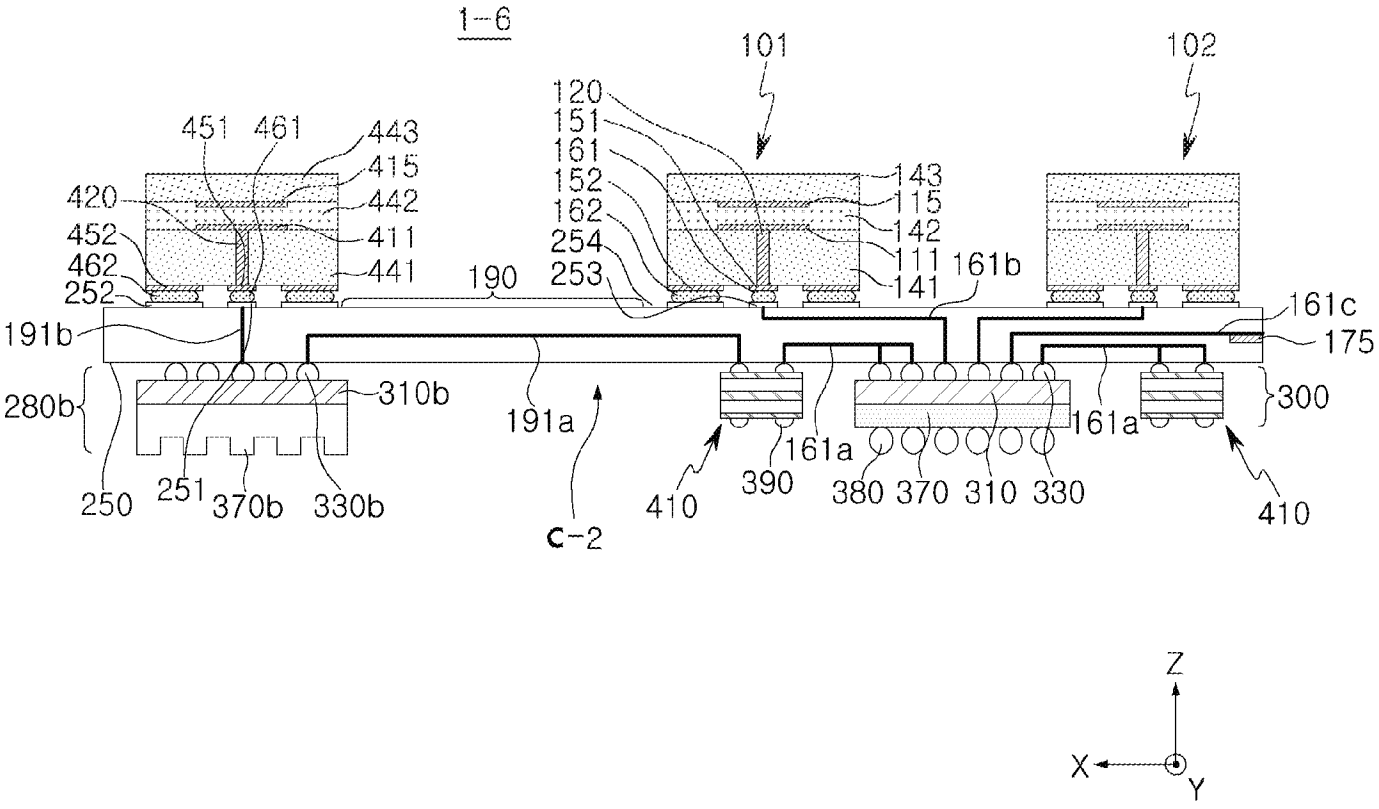
FIG. 2F is a side view illustrating a second IC package included in an antenna module, according to an embodiment.

FIG. 2F is a side view illustrating a second IC package 280*b* included in an antenna module 1-6, according to an embodiment.

Referring to FIG. 2F, the a third region 190 of a connection member C-2 of the antenna module 1-6 may provide an electrical connection path between the first IC 310 and the second IC 310*b*.

For example, the first IC 310 may be electrically connected to a first circuit wiring layer 161*a*, the first circuit wiring layer 161*a* may be electrically connected to an RF signal expansion path wire 191*a* through the core member 410, and the RF signal expansion path wire 191*a* may be electrically connected to the second IC 310*b*. The second IC 310*b* may be electrically connected to the second feed via 420 through a second RF signal expansion path wire 191*b*.

Accordingly, the first IC 310 may perform portions of operations (e.g., frequency conversion, amplification, and the like) of the second IC 310*b*, and heat produced from the second IC 310*b* may thus be reduced.

Since the first IC 310 may relatively easily provide a heat dissipation performance through a heat slug and a heat dissipation structure 380, the first IC 310 may more easily transmit heat externally as compared to the second IC 310*b*, and the first IC 310 may easily control an increase of heat caused by performing portions of operations of the second IC 310*b*.

When heat produced from the second IC 310*b* decreases, a performance of the second IC 310*b* may substantially improve, and a communication performance related to a second RF signal of a second band (e.g., 60 GHz) may also improve. Thus, in the antenna module 1-6, even though the second IC 310*b* is disposed in the second region 250 of the connection member C-2, degradation of a communication performance related to the second RF signal of the second band (e.g., 60 GHz) caused by a limitation in heat dissipation may be prevented.

Also, since the second IC 310*b* further includes a heat sink 370*b* disposed on an inactive surface of the second IC 310*b*, the second IC 310*b* may dissipate heat into the air.

An end-fire antenna 175 may be disposed in the connection member C-2. Accordingly, the end-fire antenna 175 may form a radiation pattern in a horizontal direction.

Figure 3A:
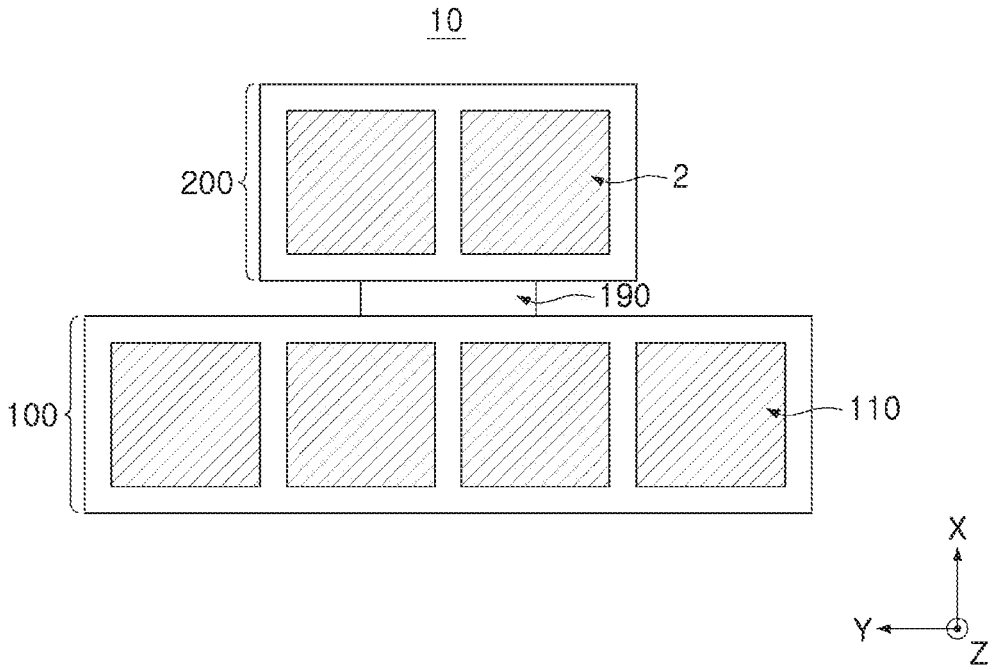
FIGS. 3A and 3B are plan views illustrating antenna modules, according to embodiments.
Figure 3B:
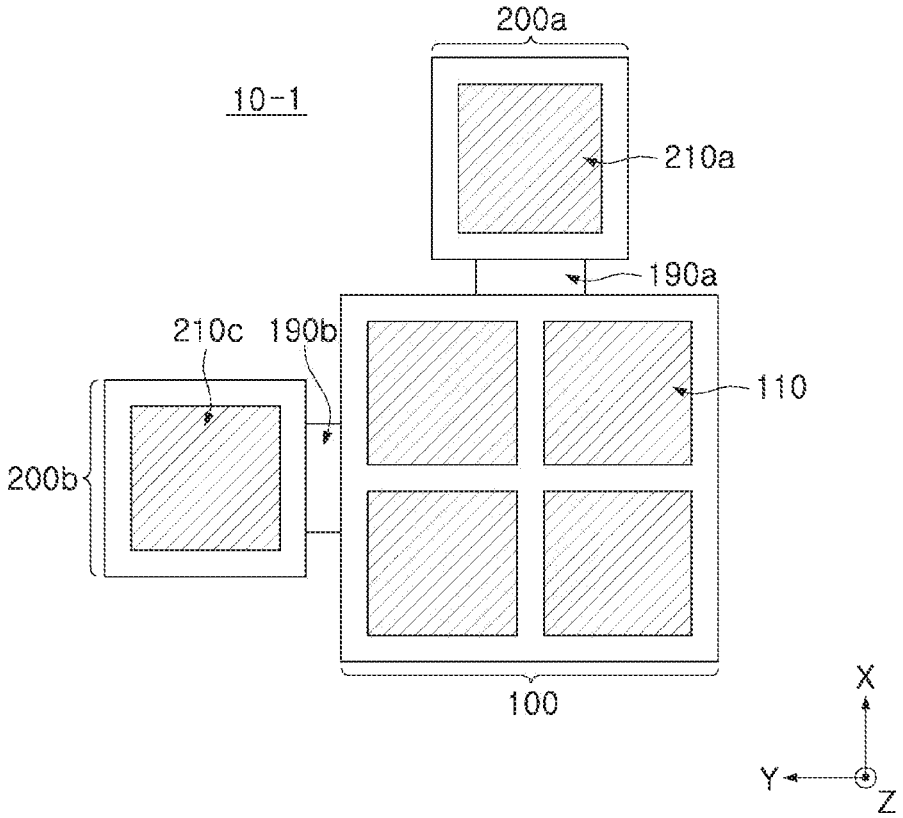

FIGS. 3A and 3B are plan views illustrating antenna modules 10 and 10-1, according to embodiments.

Referring to FIG. 3A, in the antenna module 10, the expansion module 200 may be expanded to and disposed in one region (e.g., in the x direction) of the base module 100. The number of second patch antenna patterns 210 included in the expansion module 200 may be two or more.

Referring to FIG. 3B, the antenna module 10-1 may include first and second expansion modules 200*a* and 200*b*. The first expansion module 200*a* may be electrically connected to the base module 100 through a fifth region 190*a* of a connection member, and the second expansion module 200*b* may be electrically connected to the base module 100 through the fourth region 190*b* of the connection member.

Accordingly, a direction and/or a position in which an RF signal is remotely transmitted and received may be determined flexibly in an electronic device.

Figure 3C:
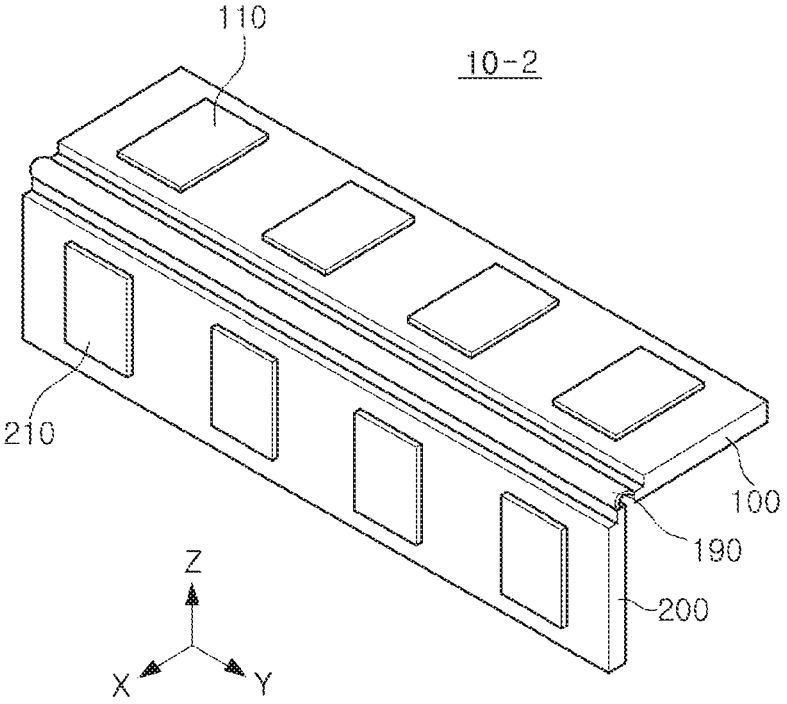
FIG. 3C is a perspective view illustrating an antenna module, according to an embodiment.

FIG. 3C is a perspective view illustrating an antenna module 10-2, according to an embodiment.

Referring to FIG. 3C, the base module 100 and the expansion module 200 may include the first and second patch antenna patterns 110 and 210, respectively, and may be flexibly connected to each other through the third region 190 of a connection member.

Each of the first and second patch antenna patterns 110 and 210 may be arranged in a 4×1 structure. However, an arrangement of the first and second patch antenna patterns 110 and 210 is not limited to this example.

Figure 4A:
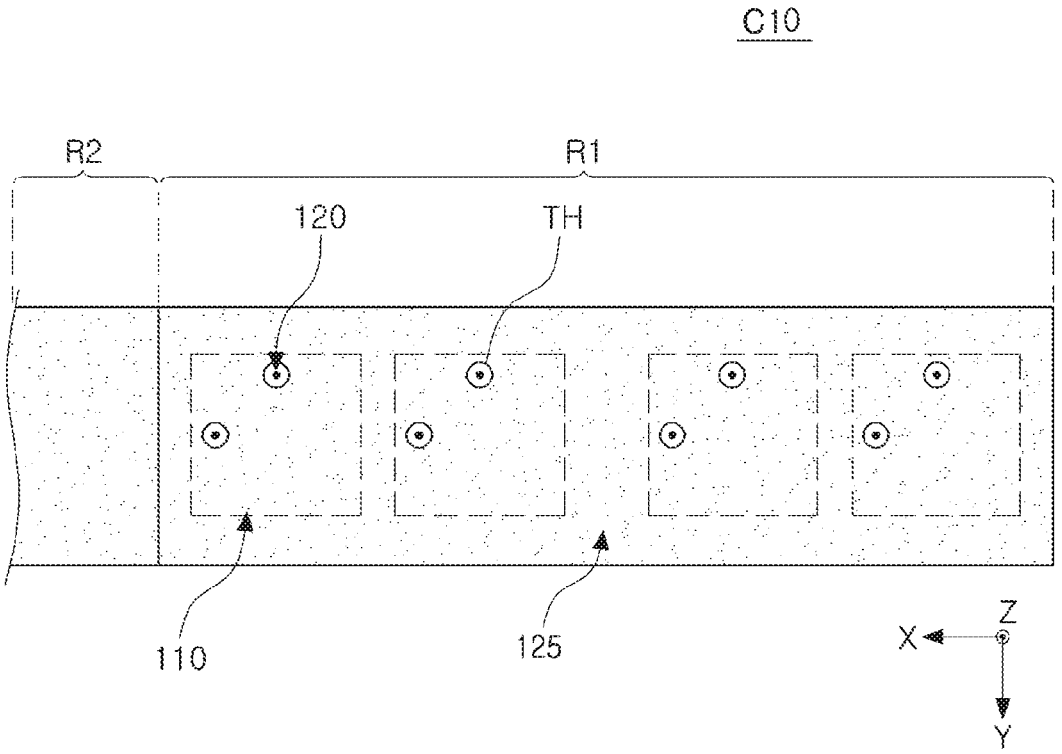
FIGS. 4A and 4B are plan views illustrating a first region and a third region of a connection member of an antenna module, according to an embodiment.
Figure 4B:
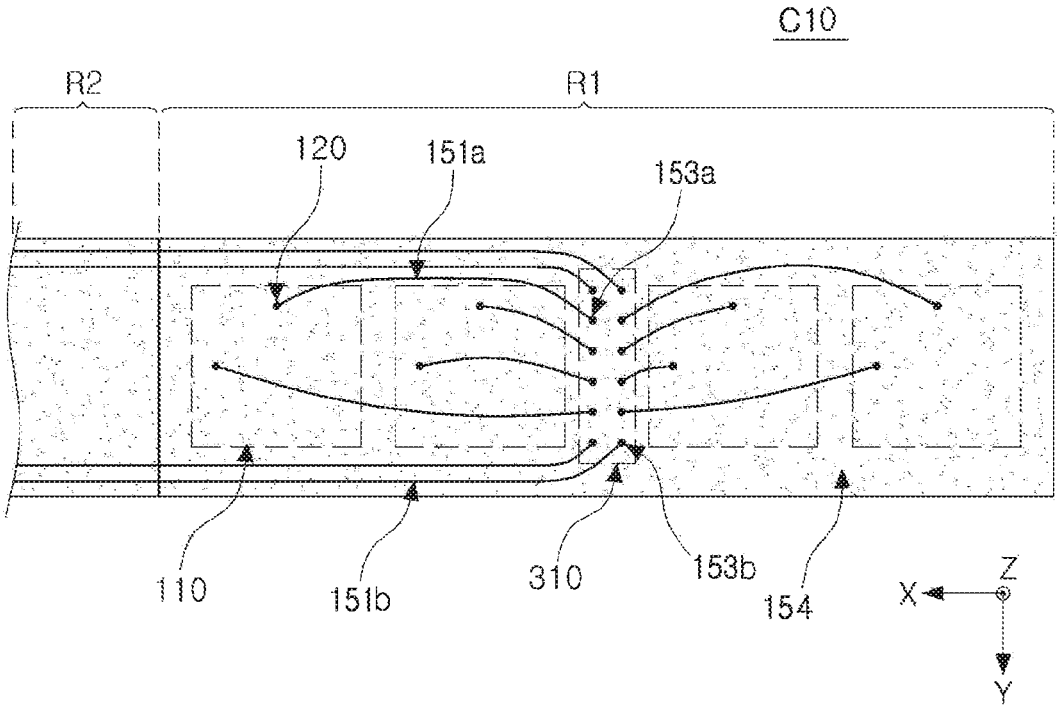

FIGS. 4A and 4B are plan views illustrating a first region R1 and a third region R2 of a connection member C10 of an antenna module, according to an embodiment.

Referring to FIG. 4A, the first ground layer 125 may include a plurality of through-holes TH, and may overlap a disposition space in which the patch antenna pattern 110 is disposed in the z direction.

The plurality of feed vias 120 may be configured to penetrate the plurality of through-holes TH, respectively.

Referring to FIG. 4B, a wiring ground layer 154 may be disposed more adjacent to an IC than the first ground layer 125 illustrated in FIG. 4A, and may provide a disposition space in which first and second feed lines 151*a* and 151*b* are disposed. That is, a distance between the wiring ground layer 154 and the IC may be less than a distance between the first ground layer 125 and the IC. The wiring ground layer 154 may be spaced apart from the first and second feed lines 151*a* and 151*b*, and may be configured to surround the first and second feed lines 151*a* and 151*b*.

The first feed line 151*a* may electrically connect a feed via 120 and a first wiring via 153*a*.

The second feed line 151*b* may extend from a second wiring via 153*b* to the third region R2, and may be electrically connected to a second patch antenna pattern.

The first and second wiring vias 153*a* and 153*b* may be configured to overlap a disposition space in which the first IC 310 is disposed in the z direction, and may be electrically connected to the first IC 310.

Figure 5A:
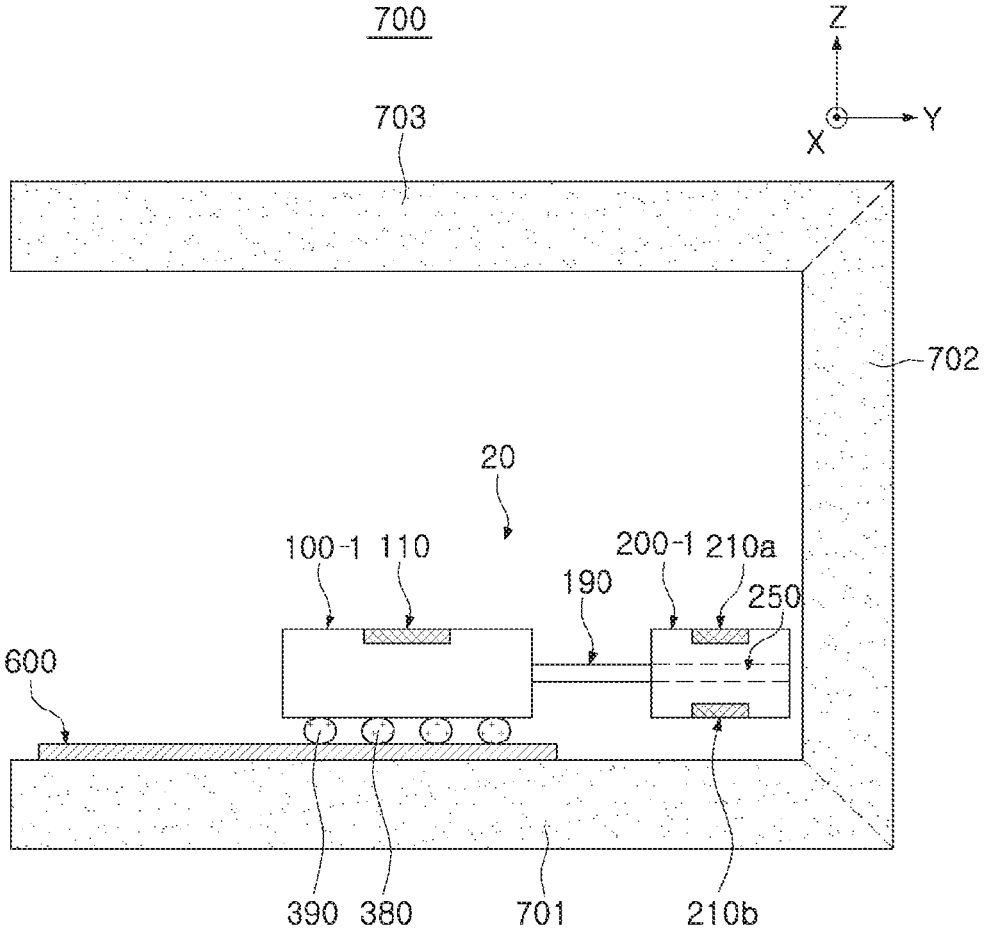
FIGS. 5A to 5C are side views illustrating antenna modules included in electronic devices, according to embodiments.
Figure 5B:
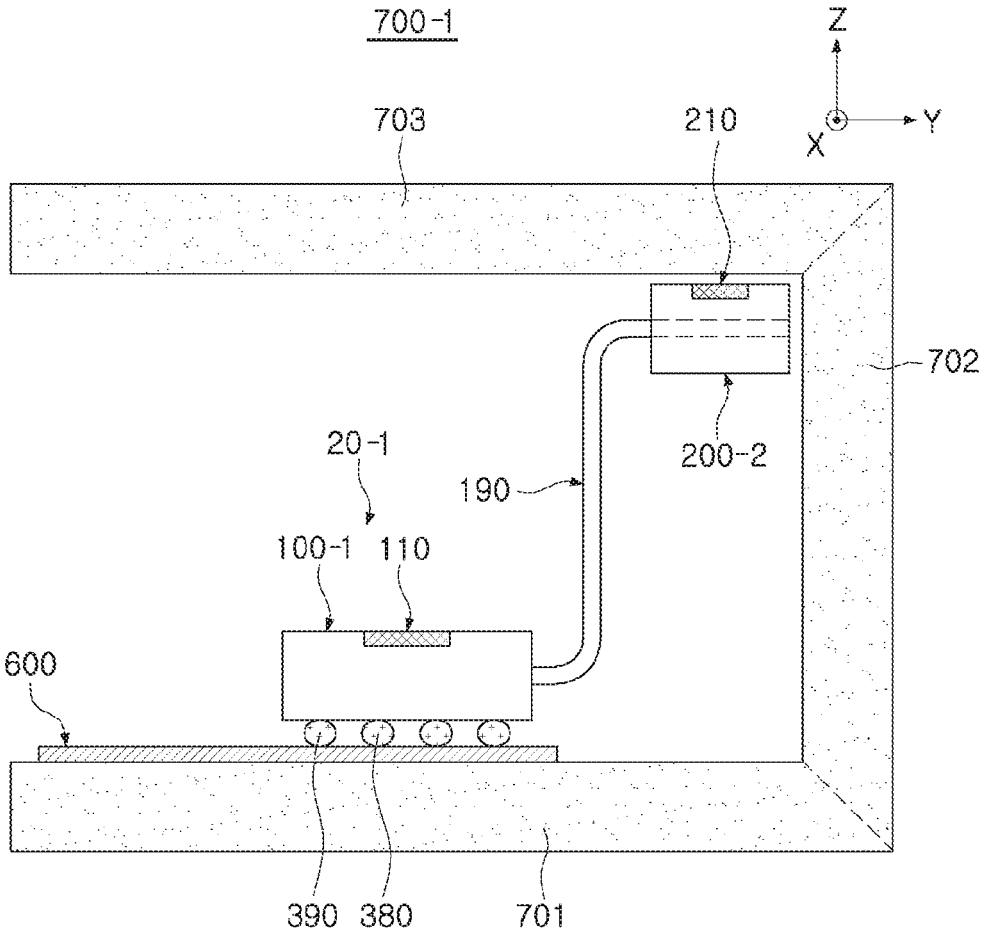
Figure 5C:
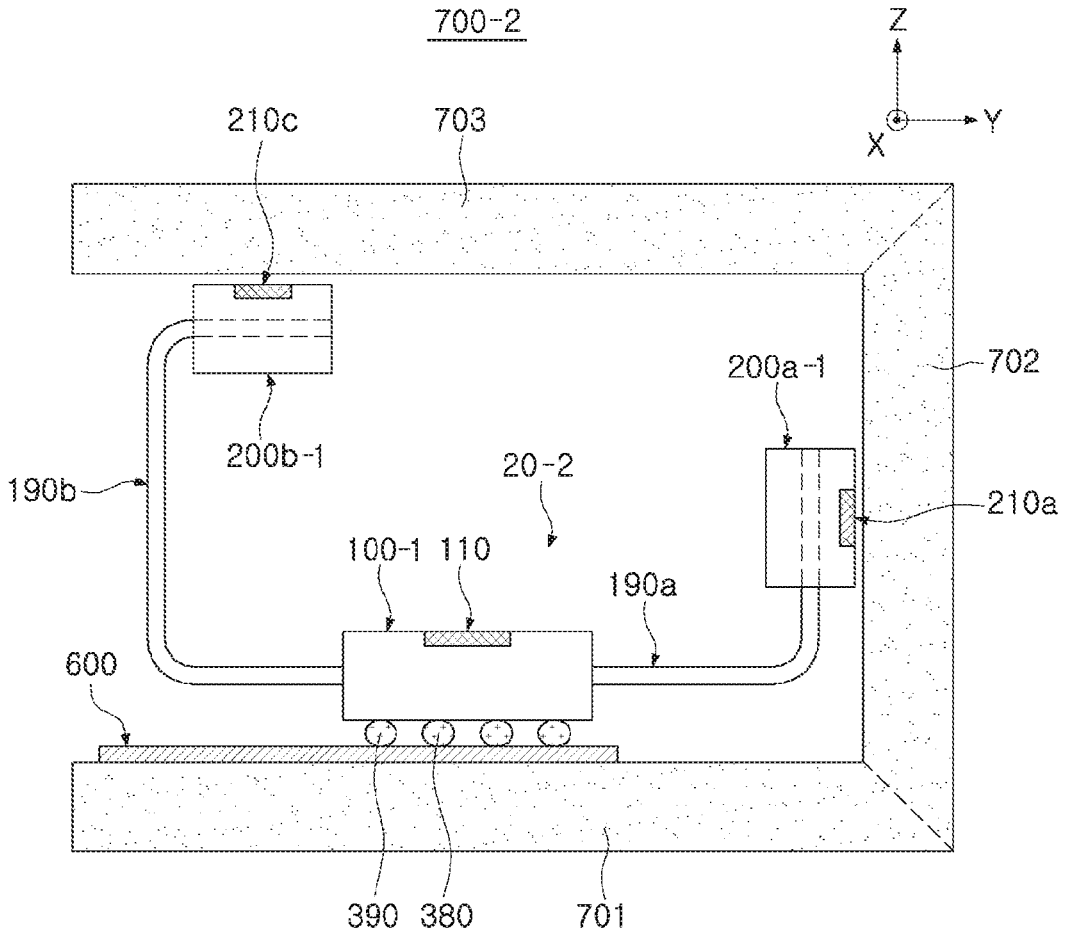

FIGS. 5A to 5C are side views illustrating antenna modules included in electronic devices, according to embodiments.

Referring to FIGS. 5A to 5C, electronic devices 700, 700-1, and 700-2 may include a case including a first surface 701, a second surface 702, and a third surface 703, and may also include a set substrate 600 disposed in the case.

A base module 100-1 of the antenna modules 20, 20-1, and 20-2 may be mounted on the set substrate 600 through a mounting electrical interconnect structure 390.

A first patch antenna pattern 110 may be disposed more adjacent to the first surface 701 than to the second surface 702 of the case, and a second patch antenna pattern 210/210*a* may be disposed more adjacent to the second surface 702 than to the first surface 701 of the case.

Accordingly, a likelihood that an RF signal transmitted from and received in the first patch antenna pattern 110 and the second patch antenna pattern 210/210*a* is interfered with by an obstacle (e.g., a display panel, a battery, and the like) in the electronic device 700/700-1/700-2 or an external obstacle (e.g., a user's hand) may be easily reduced.

For example, a plane (e.g., an upper surface) of the first patch antenna pattern 110 and a plane (e.g., an upper surface) of the second patch antenna pattern 210/210*a* may be configured to be oriented in the z direction.

Referring to FIG. 5A, an expansion module 200-1 of the antenna module 20 may be disposed more adjacent to the first surface 701 than to the third surface 703 of the electronic device 700.

Referring to FIG. 5B, the expansion module 200-2 of the antenna module 20-1 may be disposed more adjacent to the third surface 703 than to the first surface 701 of the electronic device 700-1.

Referring to FIG. 5C, a direction in which the plane of the first patch antenna pattern 110 is oriented may be different from a direction in which the plane of the second patch antenna pattern 210*a* is oriented.

Accordingly, the antenna modules 20, 20-1, and 20-2 and the electronic devices 700, 700-1, and 700-2 may use a relatively high gain of the patch antenna omnidirectionally.

For example, a second antenna portion including the second patch antenna pattern 210/210*a* may be configured to have a second bandwidth including 60 GHz, and a first antenna portion including the first patch antenna pattern 110 may be configured to have a first bandwidth having a maximum frequency lower than a minimum frequency of the second bandwidth.

The second band including 60 GHz may be relatively appropriate for remotely transmitting a large volume of data to and receiving a large volume of data from a communication object disposed relatively close to the electronic device 700/700-1/700-2, and the first band (e.g., 28 GHz and 39 GHz) lower than 60 GHz may be relatively appropriate for remotely transmitting data to and receiving data from a communication object disposed relatively remote from the electronic device 700/700-1/700-2.

The second surface 702 of the electronic device 700/700-1/700-2 may have an area smaller than an area of the first surface 701. For example, the second surface 702 may correspond to a side surface of a portable terminal device, and the first surface 701 may correspond to an upper surface or a lower surface of a portable terminal device.

The second patch antenna pattern 210*a* (FIGS. 5A and 5C) may be disposed more adjacent to the second surface 702 than the first patch antenna pattern 110. That is a distance between the second patch antenna pattern 210*a* and the second surface 702 may be less than a distance between the first patch antenna pattern 110 and the second surface 702. For example, the second patch antenna pattern 210*a* may be disposed adjacent to a side surface of a portable terminal device.

When the electronic device 700/700-1/700-2 performs a long distance communication of the first band through the first surface 701 or the third surface 703 having a relatively large area, the electronic device 700/700-1/700-2 may form a radiation pattern having a relatively high gain such that a decrease of energy of a first RF signal in the air may be effectively prevented.

When the electronic device 700/700-1/700-2 performs a large-scale near-field communications of the second band corresponding to 60 GHz through the second surface 702 having a relatively small area, the electronic device 700/700-1/700-2 may easily focus a radiation pattern to a communication object (e.g., another portable terminal device) such that communication stability may improve. Additionally, because the electronic device 700/700-1/700-2 may have a near-field communication direction appropriate for a structure in which a user holds the electronic device 700/700-1/700-2 with his/her hand, user convenience may also improve.

Further, electromagnetic isolation between the first and second bands may also improve.

Referring to FIG. 5A, a third patch antenna pattern 210*b* of the expansion module 200-1 may be disposed on a lower surface of the second region 250 of the connection member.

Referring to FIG. 5C, a second patch antenna pattern 210*a* of a first expansion module 200*a*-1 may be disposed on a lower surface of the fifth region 190*a* of the connection member, and a third patch antenna pattern 210*c* of a second expansion module 200*b*-1 may be disposed on a lower surface of the fourth region 190*b* of the connection member.

Figure 5D:
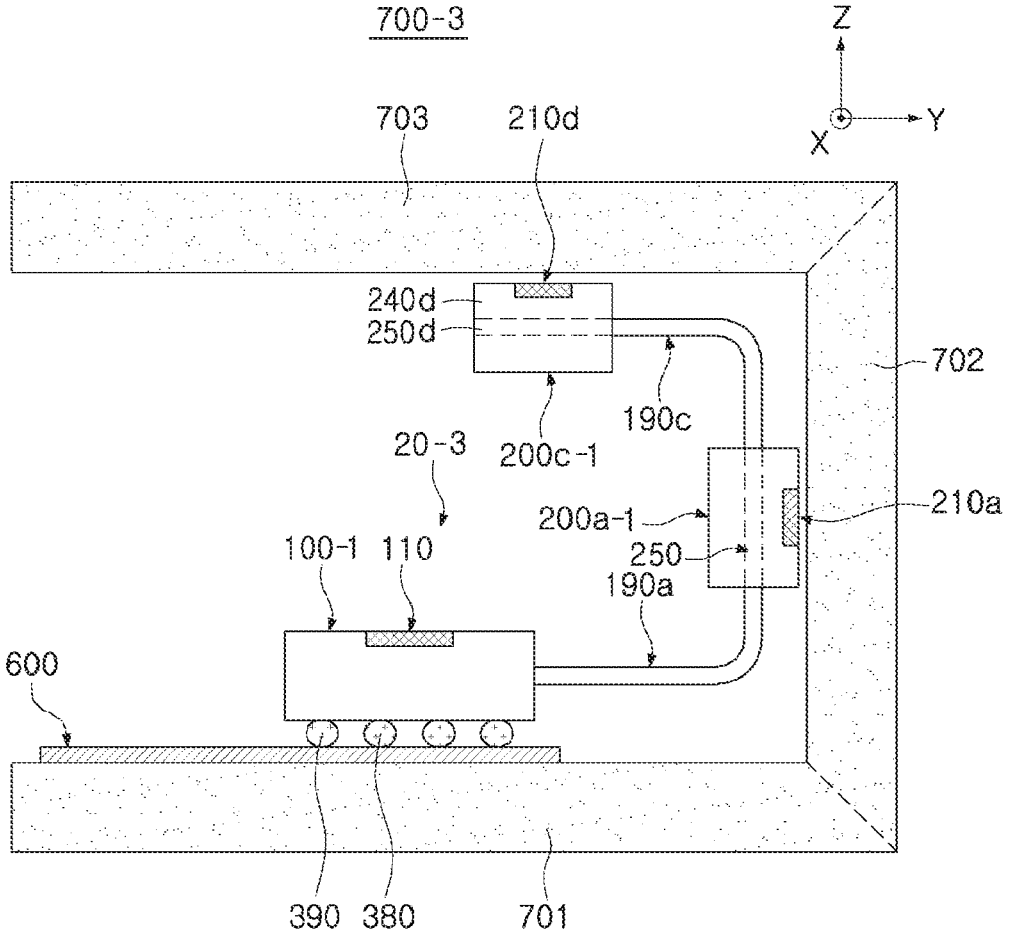
FIG. 5D is a side view illustrating an electronic device including an antenna module that includes a fourth antenna portion, according to an embodiment.

FIG. 5D is a side view illustrating an electronic device 700-3 including an antenna module 20-3 that includes a fourth antenna portion 240*d*, according to an embodiment.

Referring to FIG. 5D, the antenna module 20-3 may include a third expansion module 200*c*-1 including a fourth antenna portion 240*d*. The fourth antenna portion 240*d* may include a fourth patch antenna pattern 210*d*.

The connection member may further include a fourth region 250*d* providing a surface on which the fourth antenna portion 240*d* is disposed, and a sixth region 190*c* electrically connecting the fourth region 250*d* and the second region 250.

Accordingly, a likelihood that an RF signal remotely transmitted from and received in the first, second, and fourth patch antenna patterns 110, 210*a*, and 210*d* is interfered with by an obstacle (e.g., a display panel, a battery, and the like) in the electronic device 700-3 or an external obstacle (e.g., a user's hand) may be easily reduced.

A signal transmitted from a sixth region 190*c* may be generated from a second IC (e.g., the second IC 310*b* in FIG. 2) disposed on a lower surface of the second region 250, in which the second patch antenna pattern 210*a* is disposed on an upper surface of the second region 250. Transmission loss of an RF signal transmitted from and received in the fourth patch antenna pattern 210*d* in the connection member may reduce as the second IC is disposed on a lower surface of the second region.

The sixth region 190*c* may act as a path through which heat produced from the second IC is dissipated externally. Thus, the sixth region 190*c* may assist a heat dissipation performance of the second IC.

Figure 6A:
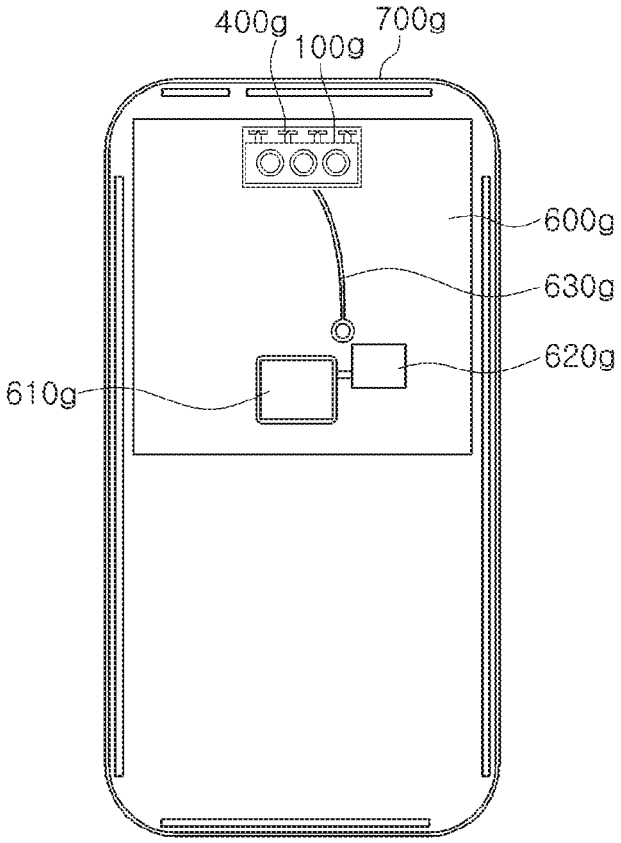
FIGS. 6A to 6B are plan views illustrating electronic devices, according to embodiments.
Figure 6B:
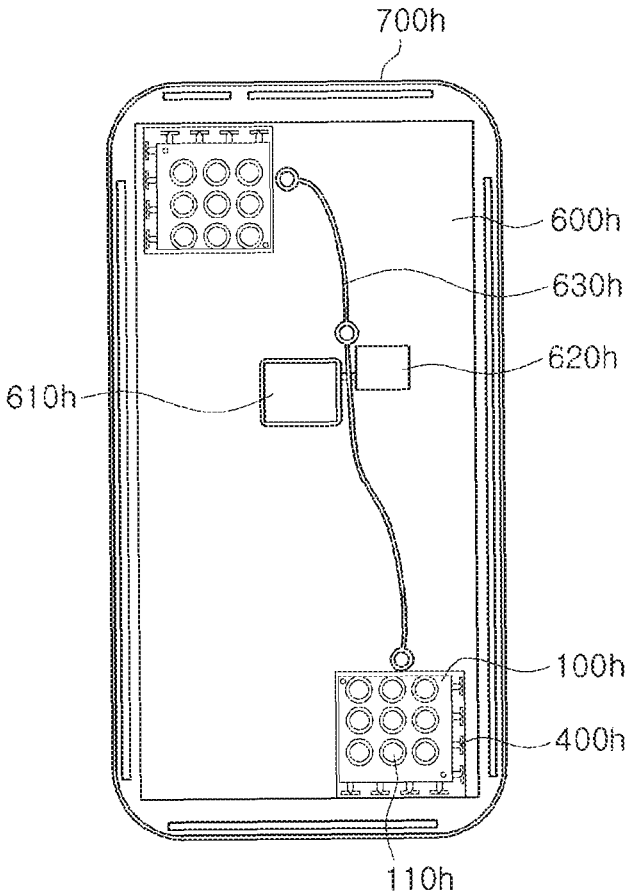

FIGS. 6A to 6B are plan views illustrating electronic devices 700*g* and 700*h*, respectively, according to embodiments.

Referring to FIG. 6A, the antenna module including a base module 100*g* and an expansion module 400*g* may be disposed on a set substrate 600*g*, and may be disposed in the electronic device 700*g*.

The electronic device 700*g* may be implemented as a smartphone, a personal digital assistant, a digital video camera, a digital still camera, a network system, a computer, a monitor, a tablet, a laptop, a netbook, a television, a video game, a smart watch, an automotive electronic device, or the like. However, the electronic device 700*g* is not limited to the provided examples.

A communication module 610*g* and a second IC 620*g* may further be disposed on the set substrate 600*g*. The antenna module may be electrically connected to the communication module 610*g* and/or the second IC 620*g* through a coaxial cable 630*g*.

The communication module 610*g* may include at least portions of a memory chip such as a volatile memory (e.g., DRAM), a non-volatile memory (e.g., ROM), a flash memory, and the like; an application processor chip such as a central processor (e.g., CPU), a graphic processor (e.g., GPU), a digital signal processor, a cryptographic processor, a microprocessor, a microcontroller, or the like, and a logic chip such as an analog-to-digital (ADC) converter, an application-specific integrated circuit (ASIC), or the like.

The second IC 620*g* may generate a base signal by performing operations of analog to digital conversion, amplification of an analog signal, filtering, and frequency conversion. A base signal input from and output to the second IC 620*g* may be transferred to the antenna module through the coaxial cable. When a base signal is an IF signal, the second IC 620*g* may be implemented as an intermediate frequency integrated circuit (IFIC). When a base signal is a baseband signal, the second IC 620*g* may be implemented as a base band integrated circuit (BBIC).

For example, the base signal may be transferred to the IC through an electrical interconnect structure, a core via, and a circuit wire. The IC may convert the base signal into an RF signal of mmWave band.

Referring to FIG. 6B, a plurality of antenna modules each including a base module 100*h*, a first patch antenna pattern 110*h*, and an expansion module 400*h* may be disposed adjacent to a boundary of one side surface and a boundary of another side surface of the electronic device 700*h* on a set substrate 600*h* of the electronic device 700*h*, and a communication module 610*h* and a second IC 620*h* may further be disposed on the set substrate 600*h*. The antenna modules may be electrically connected to the communication module 610*h* and/or the second IC 620*h* through the coaxial cable 630*g*.

Figure 6C:
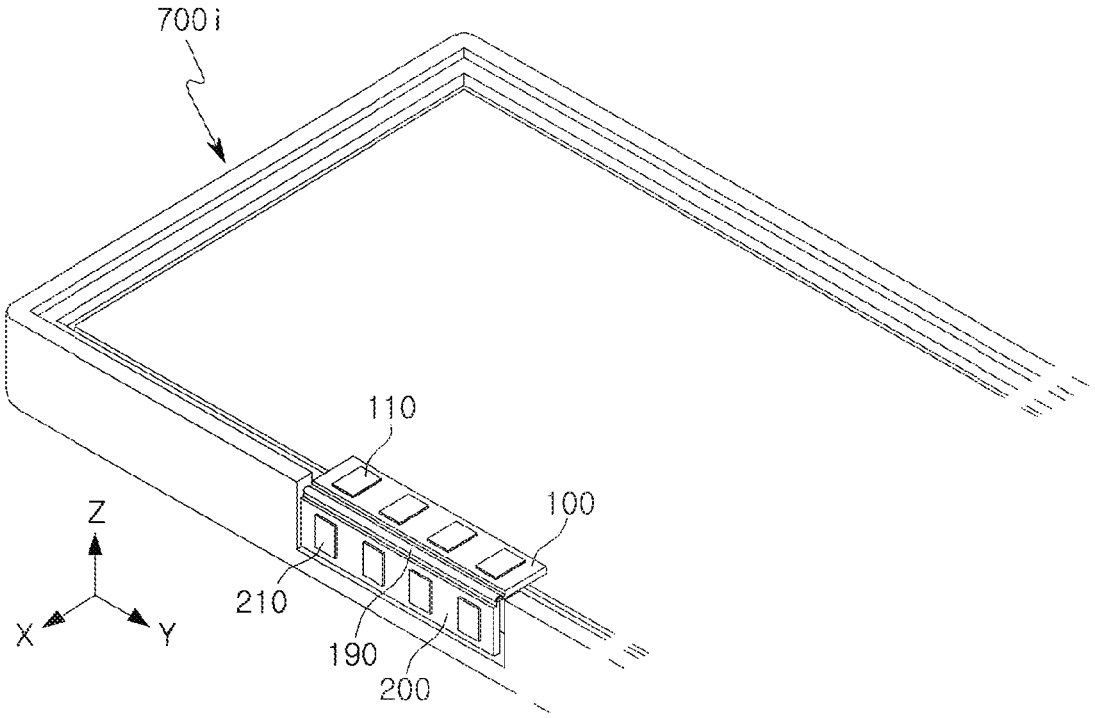
FIG. 6C is a perspective view illustrating an electronic device, according to an embodiment.

FIG. 6C is a perspective view illustrating an electronic device 700*i*, according to an embodiment.

Referring to FIG. 6C, the electronic device 700*i* may have a structure in which the antenna module 10-2 illustrated in FIG. 3C is disposed on an edge of the electronic device 700*i*.

The patch antenna pattern, the coupling patch pattern, the feed via, the ground layer, the coupling structure, the wiring layer, the wiring via, the electrical interconnect structure, the heat slug, the heat dissipation structure, and the end-fire antenna in the example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) process, a physical vapor deposition (PVD) process, a sputtering process, a subtractive process, an additive process, a semi-additive process (SAP), a modified semi-additive process, or the like. However, the materials of the foregoing components and the method of forming the foregoing components are not limited to the provided examples.

The dielectric layer in the embodiments disclosed herein may be implemented by prepreg, FR4, LTCC, LCP, and polyimide, and may also be implemented by a thermosetting resin such as an epoxy resin, a thermoplastic rein, a resin in which the thermosetting resin or the thermoplastic resin is impregnated with an inorganic filler in a core material such as a glass fiber (or a glass fiber, a glass cloth, or a glass fabric), an Ajinomoto build-up film (ABF), bismaleimide triazine (BT), a photoimagable dielectric (PID) resin, a copper clad laminate (CCL), an insulating material based on ceramic, or the like.

The RF signal in the embodiments disclosed herein may be based on Wi-Fi (IEEE 802.11 family, and the like), WiMAX (IEEE 802.16 family, and the like), IEEE 802.20, LTE (long term evolution), Ev-DO, HSPA+, HSDPA+, HSUPA+, EDGE, GSM, GPS, GPRS, CDMA, TDMA, DECT, Bluetooth, 3G, 4G, 5G, or other latest random wireless and wired protocols, but an example embodiment thereof is not limited thereto. Also, a frequency (e.g., 24

GHz, 28 GHz, 36 GHz, 39 GHz, 60 GHz) of an RF signal may be higher than a frequency (e.g., 2 GHz, 5 GHz, 10 GHz, and the like) of an IF signal.

According to the aforementioned example embodiments, an antenna module may have a structure which may improve an antenna performance (e.g., gain, bandwidth, directivity, and the like) and/or may reduce a size of the antenna. Further, the antenna module may easily expand a direction in which an RF signal is transmitted and received without substantially compromising an antenna performance or a size of an antenna, and may remotely transmit and receive an RF signal effectively without being interfered with by an external obstacle (e.g., another device in the electronic device, a user's hand holding the electronic device, and the like).

Also, an overall antenna performance related to the first and second frequencies, which are different from each other, may improve, and electromagnetic interference between the first and second frequencies may easily be reduced without significantly increasing an effective size of the antenna.

The communication modules 610*g* and 610*h* in FIGS. 6A and 6B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module, comprising:

a first integrated circuit (IC) package comprising a first IC;

a second IC package comprising a second IC;

a first antenna portion comprising a first patch antenna pattern, a first feed via electrically connected to the first patch antenna pattern, and a first antenna dielectric layer surrounding the first feed via, and configured to have a first resonance frequency;

a second antenna portion comprising a second patch antenna pattern, a second feed via electrically connected to the second patch antenna pattern, and a second antenna dielectric layer surrounding the second feed via, and configured to have a second resonance frequency different from the first resonance frequency; and a connection member comprising an upper surface on which the first and second antenna portions are disposed and a lower surface on which the first IC package is disposed, and having a laminated structure forming an electrical connection path between the first IC and the first feed via and forming an electrical connection path of the second antenna portion, wherein the connection member further comprises:

a first region disposed between the first IC package and the first antenna portion;

a second region on which the second antenna portion is disposed, the second region being disposed between the second IC package and the second antenna portion, and forming an electrical connection path between the second IC and the second antenna portion; and a third region electrically connecting the first and second regions to each other and configured to be more flexible than the first antenna dielectric layer.

2. The antenna module of claim 1, wherein the second antenna portion is configured to have a second bandwidth including 60 GHz, and wherein the first antenna portion is configured to have a first bandwidth having a maximum frequency lower than a minimum frequency of the second bandwidth.

3. The antenna module of claim 1, wherein the first IC package further comprises a heat slug disposed on an inactive surface of the first IC, and wherein the second IC package further comprises a heat sink disposed on an inactive surface of the second IC.

4. The antenna module of claim 1, wherein the first IC package further comprises:

a core member surrounding a portion of the first IC, electrically connected to the first and second ICs, and to configured to pass a base signal having a frequency lower than the first and second resonance frequencies; and a mounting electrical interconnect structure electrically connected to the core member and having a melting point lower than a melting point of the first feed via.

5. The antenna module of claim 1, wherein the connection member forms an electrical connection path between the first IC and the second IC, and wherein the first IC package further comprises a heat slug disposed on an inactive surface of the first IC.

6. The antenna module of claim 1, wherein the connection member further comprises a fourth region connected to the first region and configured to be more flexible than the first antenna dielectric layer, and wherein the fourth region is configured to pass a base signal having a frequency lower than the first and second resonance frequencies.

7. The antenna module of claim 1, further comprising:

an end-fire antenna electrically connected to the second IC and configured to form a radiation pattern in a direction different from a direction of a radiation pattern of the second antenna portion, wherein the second region is disposed between the end-fire antenna and the second antenna portion.

8. The antenna module of claim 1, wherein either one or both of the first and second antenna portions further comprises an antenna interconnect structure disposed on the upper surface of the connection member to electrically connect the first feed via or the second feed via to the connection member, and having a melting point lower than a melting point of the first feed via or the second feed via.

9. The antenna module of claim 1, wherein either one or both of the first and second antenna portions further comprises a coupling patch pattern disposed on and spaced apart from the first patch antenna pattern or the second patch antenna pattern.

10. An electronic device, comprising:

a case;

a set substrate disposed in the case; and an antenna module disposed in the case and electrically connected to the set substrate, wherein the antenna module comprises:

a first IC package comprising a first IC;

a first antenna portion comprising a first patch antenna pattern, a first feed via electrically connected to the first patch antenna pattern, and a first antenna dielectric layer surrounding the first feed via, and configured to have a first resonance frequency;

a second antenna portion comprising a second patch antenna pattern, a second feed via electrically connected to the second patch antenna pattern, and a second antenna dielectric layer surrounding the second feed via, and configured to have a second resonance frequency different from the first resonance frequency; and a connection member comprising an upper surface on which the first and second antenna portions are disposed and a lower surface on which the first IC package is disposed, and having a laminated structure forming an electrical connection path between the first IC and the first feed via and forming an electrical connection path of the second antenna portion, wherein the connection member further comprises:

a first region disposed between the first IC package and the first antenna portion;

a second region on which the second antenna portion is disposed, the second region being disposed between the second IC package and the second antenna portion, and forming an electrical connection path between the second IC and the second antenna portion; and a third region electrically connecting the first and second regions to each other and configured to be more flexible than the first antenna dielectric layer.

11. The electronic device of claim 10, wherein the second antenna portion is configured to have a second bandwidth including 60 GHz, and wherein the first antenna portion is configured to have a first bandwidth having a maximum frequency lower than a minimum frequency of the second bandwidth.

12. The electronic device of claim 11, wherein the case comprises a first surface, and a second surface having an area smaller than an area of the first surface, and wherein a distance between the second patch antenna pattern and the second surface is less than a distance between the first patch antenna pattern and the second surface.

13. The electronic device of claim 12, wherein the first surface comprises an upper surface or a lower surface of the case, and the second surface comprises a side surface of the case.

14. The electronic device of claim 10, further comprising:

a fourth antenna portion, wherein the connection member further comprises:

a fourth region comprising surface on which the fourth antenna portion is disposed; and a fifth region electrically connecting the fourth region and the second region to each other, and configured to be more flexible than the first antenna dielectric layer.

15. The electronic device of claim 14, wherein the fourth antenna portion comprises a fourth patch antenna.

16. An antenna module, comprising:

a first integrated circuit (IC) package comprising a first IC;

a first antenna portion comprising a first patch antenna pattern, a first feed via electrically connected to the first patch antenna pattern, and a first antenna dielectric layer surrounding the first feed via, and configured to have a first resonance frequency;

a second antenna portion comprising a second patch antenna pattern, a second feed via electrically connected to the second patch antenna pattern, and a second antenna dielectric layer surrounding the second feed via, and configured to have a second resonance frequency different from the first resonance frequency;

a third antenna portion comprising a third patch antenna pattern, a third feed via electrically connected to the third patch antenna pattern, and a third antenna dielectric layer surrounding the third feed via, and configured to have the second resonance frequency; and a connection member having a laminated structure forming an electrical connection path between the first IC and the first feed via, and forming an electrical connection path of the second and third antenna portions, wherein the connection member comprises:

a first region disposed between the first IC package and the first antenna portion;

a second region disposed between the second and third antenna portions; and a third region electrically connecting the first and second regions to each other and configured to be more flexible than the first antenna dielectric layer, wherein the first antenna portion and the second antenna portion are disposed on an upper surface of the connection member, and wherein the first IC package and the third antenna portion are disposed on a lower surface of the connection member.

* * * * *